US009518747B2

(12) United States Patent
Lee et al.

(10) Patent No.: US 9,518,747 B2
(45) Date of Patent: Dec. 13, 2016

(54) AIR CONDITIONER

(71) Applicant: SAMSUNG ELECTRONICS CO., LTD., Suwon-si, Gyeonggi-do (KR)

(72) Inventors: Wook Jin Lee, Suwon-si (KR); Ah Jung Joo, Seoul (KR); Yong Ho Lee, Suwon-si (KR)

(73) Assignee: SAMSUNG ELECTRONICS, CO., LTD, Suwon-Si (KR)

( * ) Notice: Subject to any disclaimer, the term of this patent is extended or adjusted under 35 U.S.C. 154(b) by 0 days.

(21) Appl. No.: 14/453,965

(22) Filed: Aug. 7, 2014

(65) Prior Publication Data

US 2015/0054393 A1 Feb. 26, 2015

(30) Foreign Application Priority Data

Aug. 23, 2013 (KR) ..... 10-2013-0100230

(51) Int. Cl.
*F24F 1/56* (2011.01)
*F24F 13/20* (2006.01)

(52) U.S. Cl.
CPC *F24F 1/56* (2013.01); *F24F 13/20* (2013.01)

(58) Field of Classification Search
CPC ..... A47B 47/00; A47B 47/03; A47B 47/02; A47B 47/025; F28F 9/001; F24H 9/02; F16B 12/00; F16B 12/08; D06F 39/12; H05K 7/18; H05K 5/0234; H02B 1/30; H02B 1/014; H02B 1/50; H02B 1/308; H02B 1/565; F24F 1/56; F24F 13/20
USPC ..... 312/257.1, 265.1–265.6, 351, 108, 223.1
See application file for complete search history.

(56) References Cited

U.S. PATENT DOCUMENTS 1,186,634 A * 6/1916 Weiss ..... A47B 87/02 312/108
1,473,817 A * 11/1923 Gorsline ..... A47B 57/16 108/157.17
1,798,182 A * 3/1931 Vance et al. ..... 312/263
2,527,226 A * 10/1950 Levine ..... 126/114
2,866,676 A * 12/1958 Goebel ..... 312/265.1
3,347,609 A * 10/1967 Mann ..... 312/263
3,760,970 A * 9/1973 Lutz ..... B65D 21/0215 206/511
4,265,500 A * 5/1981 Berton et al. ..... 312/107
4,307,588 A * 12/1981 Smith ..... D06F 39/12 312/257.1
4,618,193 A * 10/1986 Cuthbert et al. ..... 312/264
4,650,085 A * 3/1987 Davies et al. ..... 220/4.02
5,197,789 A * 3/1993 Lin ..... G06F 1/181 312/223.2

(Continued)

*Primary Examiner* — Andrew Roersma
(74) *Attorney, Agent, or Firm* — Staas & Halsey LLP

(57) ABSTRACT

An air conditioner having an improved assembly structure of panels includes a lower panel located at a bottom surface thereof, an upper panel located at an upper surface thereof, front and rear panels located at front and rear surfaces thereof, and side panels to couple the front and rear panels. One side of each of the lower panel and at least one panel is provided with a protrusion and the other side thereof is provided with a coupling groove, so that the lower panel is coupled to at least one of the front panel and the side panels by coupling of the protrusion and the coupling groove. It may be possible to provide an air conditioner capable of reducing the number of fastening members coupled to respective panels and being free from restraint of an installation space.

21 Claims, 22 Drawing Sheets

(56) References Cited

U.S. PATENT DOCUMENTS

| | | | | |
|---|---|---|---|---|
| 5,244,264 | A * | 9/1993 | Woodard | F24F 13/32 312/100 |
| 5,639,150 | A * | 6/1997 | Anderson | A47B 96/145 312/265.2 |
| 5,801,331 | A * | 9/1998 | Zachrai | 174/541 |
| 6,062,665 | A * | 5/2000 | Schneider et al. | 312/265.6 |
| 6,357,610 | B1 * | 3/2002 | Irace | A47B 47/02 211/186 |
| 6,513,196 | B2 * | 2/2003 | Snowden | D06F 39/14 16/225 |
| 7,275,398 | B2 * | 10/2007 | Kim | D06F 39/12 312/228 |
| 7,494,197 | B2 * | 2/2009 | Han | D06F 39/12 312/228 |
| 7,621,156 | B2 * | 11/2009 | Kim | D06F 39/12 16/254 |
| 8,215,729 | B2 * | 7/2012 | Hunnell | D06F 39/12 312/228 |
| 2012/0062084 | A1 * | 3/2012 | Lewis et al. | 312/223.6 |
| 2013/0047689 | A1 * | 2/2013 | Sutherland | B21D 39/03 72/46 |

* cited by examiner

AIR CONDITIONER

CROSS-REFERENCE TO RELATED APPLICATIONS

This application claims the benefit of Korean Patent Application No. 10-2013-0100230, filed on Aug. 23, 2013 in the Korean Intellectual Property Office, the disclosure of which is incorporated herein by reference.

BACKGROUND

1. Field

Embodiments disclosed herein relate to an air conditioner having an improved assembly structure of panels defining an external appearance thereof.

2. Description of the Related Art

An electronic device such as an air conditioner or a boiler generally includes a plurality of panels defining an external appearance thereof. A variety of electronic components to perform functions of the electronic device may be received inside the panels.

The plurality of panels generally include a lower panel located at a bottom surface of the electronic device, an upper panel located at an upper surface thereof, front and rear panels located at front and rear surfaces thereof, and side panels to couple the front and rear panels.

The respective panels may be coupled to each other using separate fastening members provided outside the electronic device. In this case, since a certain space has to be secured when the panels are disassembled for product inspection and component replacement, there is a limitation to an installation space of the electronic device.

In addition, since the fastening members are fixed outside the panels to be exposed, the panels are deteriorated in quality due to corrosion of the fastening members and it is difficult to disassemble the fastening members.

SUMMARY

Therefore, it is an aspect of the disclosure to provide an air conditioner in which the number of fastening members to be coupled to respective panels may be reduced and the panels may be disassembled while being free from restraint of an installation space.

Additional aspects of the disclosure will be set forth in part in the description which follows and, in part, will be apparent from the description, or may be learned by practice of the invention.

In accordance with an aspect of the disclosure, an air conditioner may include a lower panel located at a bottom surface thereof, an upper panel located at an upper surface thereof, front and rear panels located at front and rear surfaces thereof, and side panels to couple the front and rear panels, wherein one side of the lower panel may be provided with a protrusion and at least one panel from among the front panel, rear panel, and side panels may be provided with a coupling groove so that the lower panel may be coupled to at least one of the front panel, rear panel, and the side panels by coupling of the protrusion and the coupling groove. Additionally, or alternatively, one side of the lower panel may be provided with a coupling groove, and at least one panel from among the front panel, rear panel, and side panels may be provided with a protrusion so that the lower panel may be coupled to at least one of the front panel, rear panel, and the side panels by coupling of the protrusion and the coupling groove.

First protrusions provided in the lower panel may be fitted into first coupling grooves provided in the side panels such that the lower panel may be coupled to the side panels.

The first protrusions may protrude toward the side panels and the first coupling grooves may be provided on inner surfaces of the side panels.

Second protrusions provided in the front and rear panels may be coupled to second coupling grooves provided in the lower panel.

The air conditioner may further include guide portions extending upward from the lower panel, and the guide portions may be coupled to guide grooves formed in the front and rear panels in order to guide coupling positions between the front and rear panels and the lower panel.

The front and rear panels may be coupled to the lower panel and the front and rear panels may be fitted to the side panels.

The upper panel may be fastened to the front and rear panels and the side panels by separate fastening members.

At least one of the side panels may be provided with a third protrusion portion which protrudes from at least a portion thereof and the third protrusion portion may be coupled to a third coupling groove provided in the upper panel.

The third protrusion portion may be provided in a first bracket coupled to the side panel and the third protrusion portion may protrude outward of the side panel.

The third coupling groove may be provided in a second bracket coupled to the upper panel.

In accordance with another aspect of the disclosure, an air conditioner may include a lower panel located at a bottom surface thereof, an upper panel located at an upper surface thereof, front and rear panels located at front and rear surfaces thereof, side panels to couple the front and rear panels, and coupling mediation members which are coupled to the lower panel to assist coupling between the front and rear panels and the lower panel and between the side panels and the lower panel.

One side of each of the coupling mediation members may be provided with a first protrusion and the first protrusion may be fitted into a first coupling groove of each of the side panels such that the lower panel may be coupled to the side panels.

One side of each of the coupling mediation members may be provided with a second coupling groove and a second protrusion provided in each of the front and rear panels may be coupled to the second coupling groove so that the front and rear panels are coupled to the lower panel.

The lower panel may further include guide portions extending upward from the lower panel in order to guide coupling between the front and rear panels and the lower panel, and the guide portions may be coupled to guide grooves formed in the front and rear panels.

The upper panel may be fastened to the front and rear panels and the side panels by separate fastening members.

A first bracket, which may be coupled to one side of one of the side panels, may be coupled to a second bracket coupled to one side of the upper panel, and the other side panel may be coupled to the other side of the upper panel by a separate fastening member.

The first bracket may be provided with a third protrusion portion protruding outward of the side panel and the second bracket may be provided with a third coupling groove having a shape corresponding to the third protrusion portion such that the third protrusion portion may be coupled to the third coupling groove.

In accordance with a further aspect of the disclosure, an air conditioner may include an upper panel located at an upper surface thereof, front and rear panels located at front and rear surfaces thereof, side panels to couple the front and rear panels, a first bracket which may be coupled to one side of one of the side panels and may be formed with a protrusion, and a second bracket which may be coupled to one side of the upper panel and may be formed with a coupling groove coupled with the protrusion, wherein the side panel may be coupled to the upper panel by coupling of the first and second brackets.

The second bracket may further include a second bracket bent portion which may be bent inward of the upper panel to come into contact with an upper surface of the side panel during coupling with the side panel.

The air conditioner may further include a third bracket coupled to one side of the other side panel, and the third bracket may be coupled to the upper panel using a separate fastening member.

In accordance with a further aspect of the disclosure, an electronic device may include a lower panel disposed at a bottom surface of the electronic device, a front panel and a rear panel disposed at front and rear surfaces of the electronic device, respectively, and side panels to couple the front and rear panels. A first side of the lower panel may be provided with a first protrusion and a side of at least one of the front panel, rear panel and side panels may be provided with a first coupling groove, to couple the lower panel to at least one of the front panel, rear panel and the side panels by coupling of the first protrusion and the first coupling groove. A second side of the lower panel, adjacent to the first side, may be provided with a second groove and a side of at least one of the front panel, rear panel and side panels may be provided with a second protrusion, to couple the lower panel to at least one of the front panel, rear panel and the side panels by coupling of the second protrusion and the second coupling groove.

The second side of the lower panel may be provided with a plurality of guide portions which extend upward from the lower panel, and the plurality of guide portions may be coupled together with guide grooves formed in the front and rear panels, such that the front and rear panels are rotatable about the lower panel.

At least one of the front and rear panels may be provided with a third protrusion, and at least one of the side panels may be provided with a third coupling groove, to couple one of the front and rear panels to at least one of the side panels.

The electronic device may further include an upper panel disposed at an upper surface of the electronic device, a first bracket, the first bracket configured to be selectively coupled to an upper surface of a first side panel or to an interior portion of a first side of the upper panel, and a second bracket coupled to an upper surface of a second side panel.

When the first bracket is coupled to the upper surface of the first side panel, fastening members pass through first and second sides of the upper panel to the first and second side panels via the first bracket and the second bracket, respectively.

When the first bracket is coupled to the interior portion of the upper panel, the fastening members pass through only the second side of the upper panel to the second side panel via the second bracket, to couple the second side of the upper panel to the second side panel, and the first bracket is coupled to a third bracket disposed on the upper surface of the first side panel, such that the upper panel is rotatable about the first side panel.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
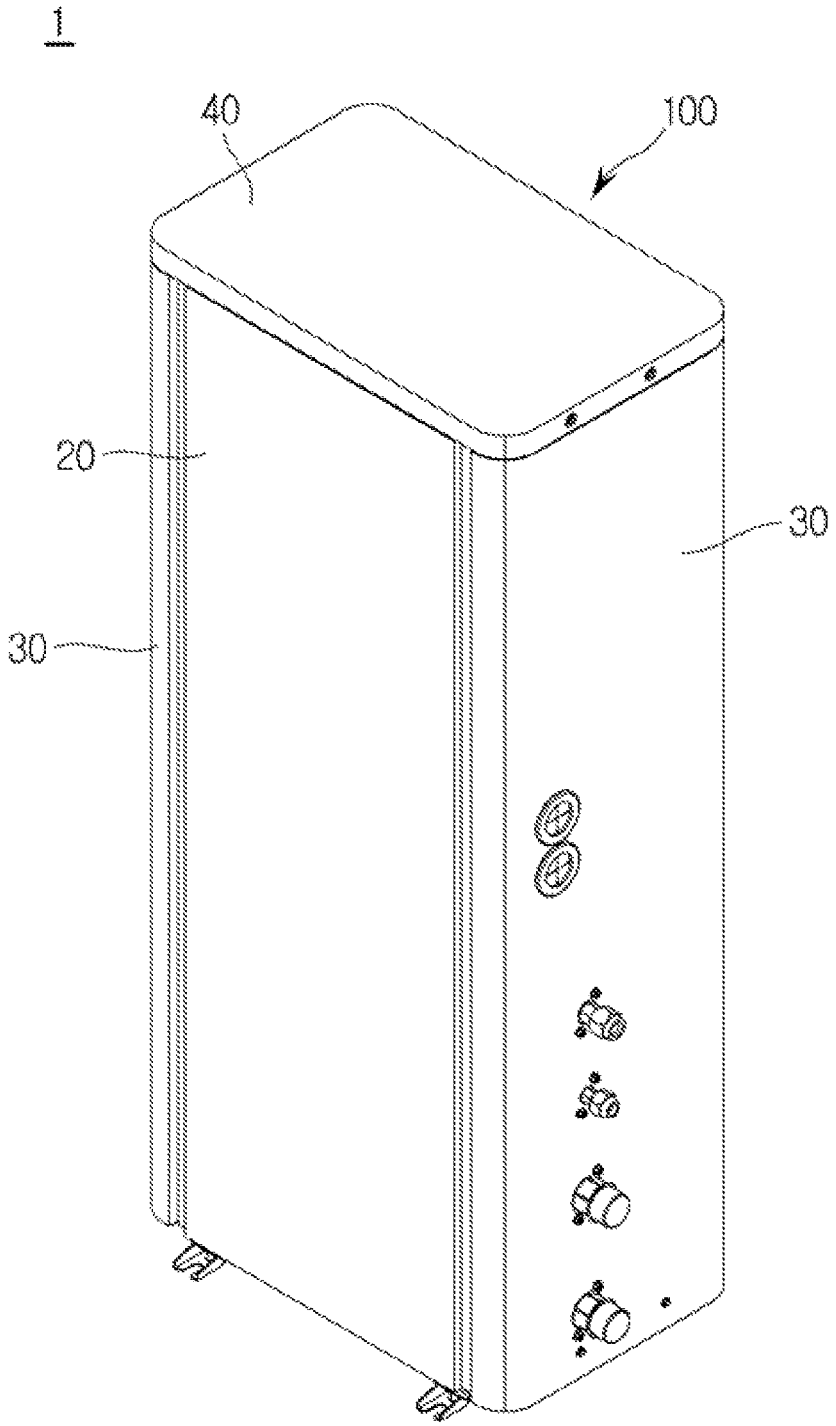
FIG. 1 is a view illustrating an external appearance of an air conditioner according to an embodiment of the disclosure.

Reference will now be made in detail to an electronic device according to the embodiments of the disclosure, examples of which are illustrated in the accompanying drawings, wherein like reference numerals refer to like elements throughout.

Figure 2:
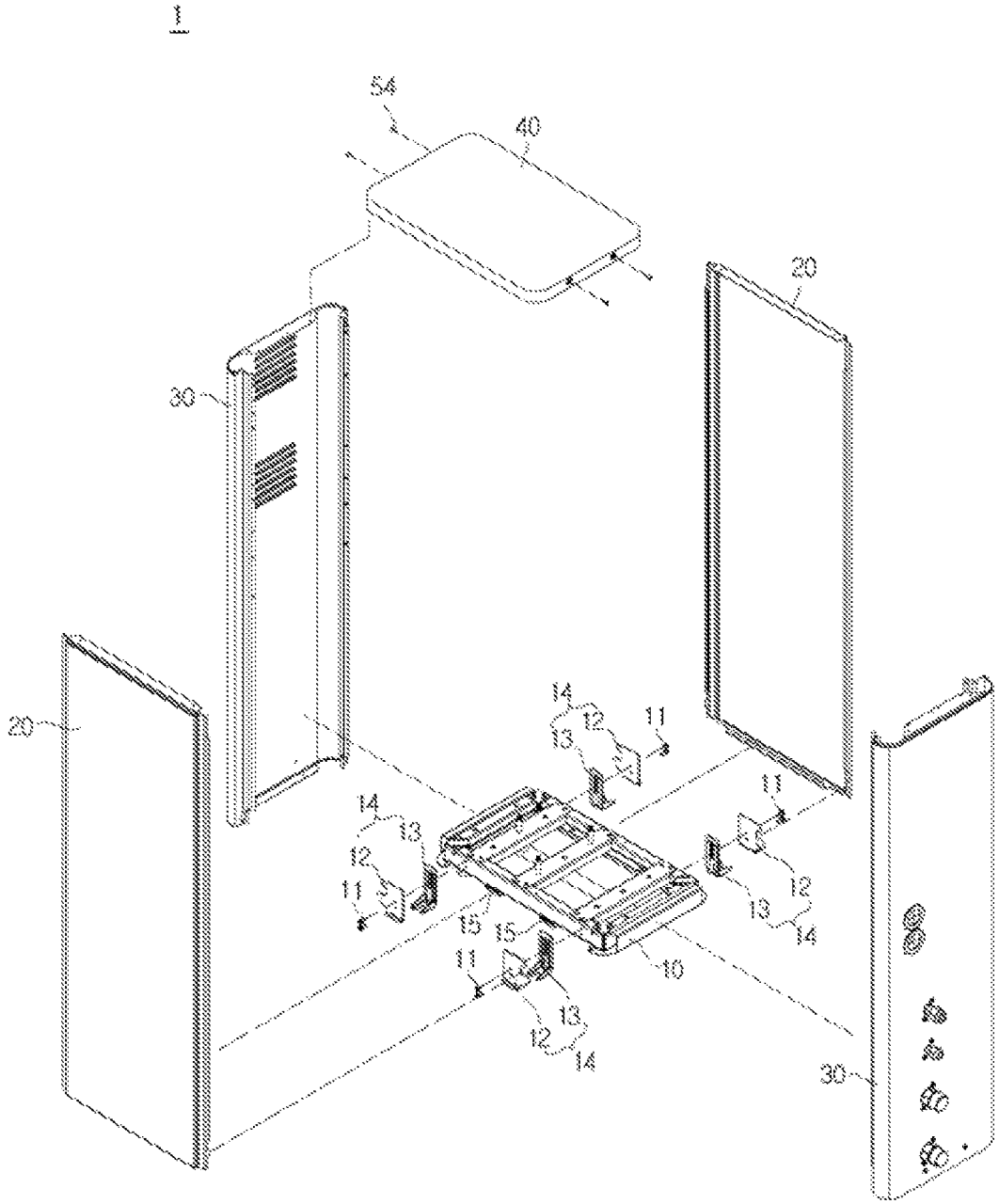
FIG. 2 is an exploded view illustrating panels of the air conditioner according to an embodiment of the disclosure.

FIG. 1 is a view illustrating an external appearance of an air conditioner according to an embodiment of the disclosure. FIG. 2 is an exploded view illustrating panels of the air conditioner according to an embodiment of the disclosure.

The disclosure exemplarily describes an air conditioner or a boiler as an electronic device, but is not limited thereto. For example, the disclosure may be applied to other kinds of electronic devices which include panels.

The electronic device according to an embodiment of the disclosure may be an air conditioner 1 for both cooling and heating. The air conditioner 1 may include a panel assembly 100 defining an external appearance thereof, an evaporator (not shown), a condenser (not shown), a pipe portion (not shown), and a compressor (not shown). The evaporator (not shown), the condenser (not shown), and the pipe portion (not shown) may be arranged inside the panel assembly 100. The compressor forming a cooling cycle may be provided in an outdoor unit. In a type of cascade cycle, another compressor may also be further provided in addition to the compressor. The compressor provided in the air conditioner 1, which may perform heating using the cascade cycle, may be mounted inside the panel assembly 100.

Refrigerant may be compressed to high-temperature and high-pressure in the compressor, phase-changed into liquid refrigerant in the condenser (not shown), and circulated via a series of cooling cycles undergoing compression-condensation-expansion-evaporation cycles so as to be evaporated in the evaporator (not shown). Then, after hot air is heat-exchanged with cold refrigerant, cold air may be supplied to the interior so that cooling may be performed. For example, a compressor provided in the outdoor unit may be used as the compressor. Heat generated when the compressor provided in the outdoor unit compresses refrigerant may be emitted to the outside.

In a case in which heating is performed by the air conditioner 1, it may be possible to perform heating using heat generated during compression of refrigerant in the compressor by reverse circulation of the cooling cycle. For example, refrigerant such as R-410A may be used as the refrigerant compressed by the compressor provided in the outdoor unit. The R-410A refrigerant may be increased to a temperature of approximately 55° C. when compressed in the compressor provided in the outdoor unit. Outdoor cold air may be supplied to the interior by heat exchange with refrigerant compressed to high-temperature and high-pressure in the compressor provided in the outdoor unit.

The air conditioner 1 may be connected to a boiler which performs heating using hot water and the air conditioner 1 may supply hot water to the boiler. Refrigerant (e.g., R-410A) compressed to high-temperature and high-pressure by the compressor provided in the outdoor unit may be increased to a temperature of approximately 55° C. The hot refrigerant may be heat-exchanged with refrigerant (R-134A) circulated in a refrigerant pipe (not shown) provided within the panel assembly 100 in the evaporator. The R-134A refrigerant may be heat-exchanged with the R-410A refrigerant and may then be compressed in the compressor provided within the panel assembly 100. The R-134A refrigerant compressed by the compressor may be increased to a temperature of approximately 85° C. The R-134A refrigerant passing through the compressor may be heat-exchanged with water in the pipe portion. The water having increased temperature via heat exchange may be introduced into the boiler to perform heating.

The panel assembly 100 defining an external appearance of the air conditioner may include a lower panel 10 located at a bottom surface thereof, an upper panel 40 located at an upper surface thereof, front and rear panels 20 located at front and rear surfaces thereof, and side panels 30 to respectively couple the front and rear panels 20. Two front and rear panels 20 and two side panels 30 may be provided. The front and rear panels 20 and the side panels 30 may be coupled between the lower panel 10 and the upper panel 40.

The lower panel 10 may be coupled with coupling mediation members 14 to assist coupling between the front and rear panels 20 and the lower panel 30 and between the side panels 30 and the lower panel 10. In accordance with an embodiment of the disclosure, each of the coupling mediation members 14 may include a first coupling mediation member 12 and a second coupling mediation member 13. The coupling mediation members 14 may be coupled to front and rear surfaces of the lower panel 10. The second coupling mediation member 13 may be located between the first coupling mediation member 12 and the lower panel 10 and coupled by a fastening member 11. For example, as shown in FIG. 2, a fastening member 11 (e.g., a screw), may be inserted through a hole or passage disposed in the first coupling mediation member 12, a hole or passage disposed in the second coupling mediation member 13, and a hole or passage disposed in the lower panel 10, to secure or couple each of the first coupling mediation member 12, second coupling mediation member 13, and lower panel 10, together.

The side panels 30 and the front and rear panels 20 may be coupled to the lower panel 10 via the coupling mediation members 14. In accordance with an embodiment of the disclosure, four coupling mediation members 14 may be coupled to the lower panel 10. One side of each of the side panels 30 and the front and rear panels 20 may be coupled to the lower panel 10 by each coupling mediation member 14, and a description thereof will be given later. For example, two coupling mediation members 14 may be used to couple a first side panel 30 to lower panel 10, and the other two coupling mediation members 14 may be used to couple a second side panel 30 to lower panel 10, on the opposite side. For example, two coupling mediation members 14 may be used to couple a front panel 20 to lower panel 10, and the other two coupling mediation members 14 may be used to couple the rear panel 20 to lower panel 10, on the opposite side.

Figure 3:
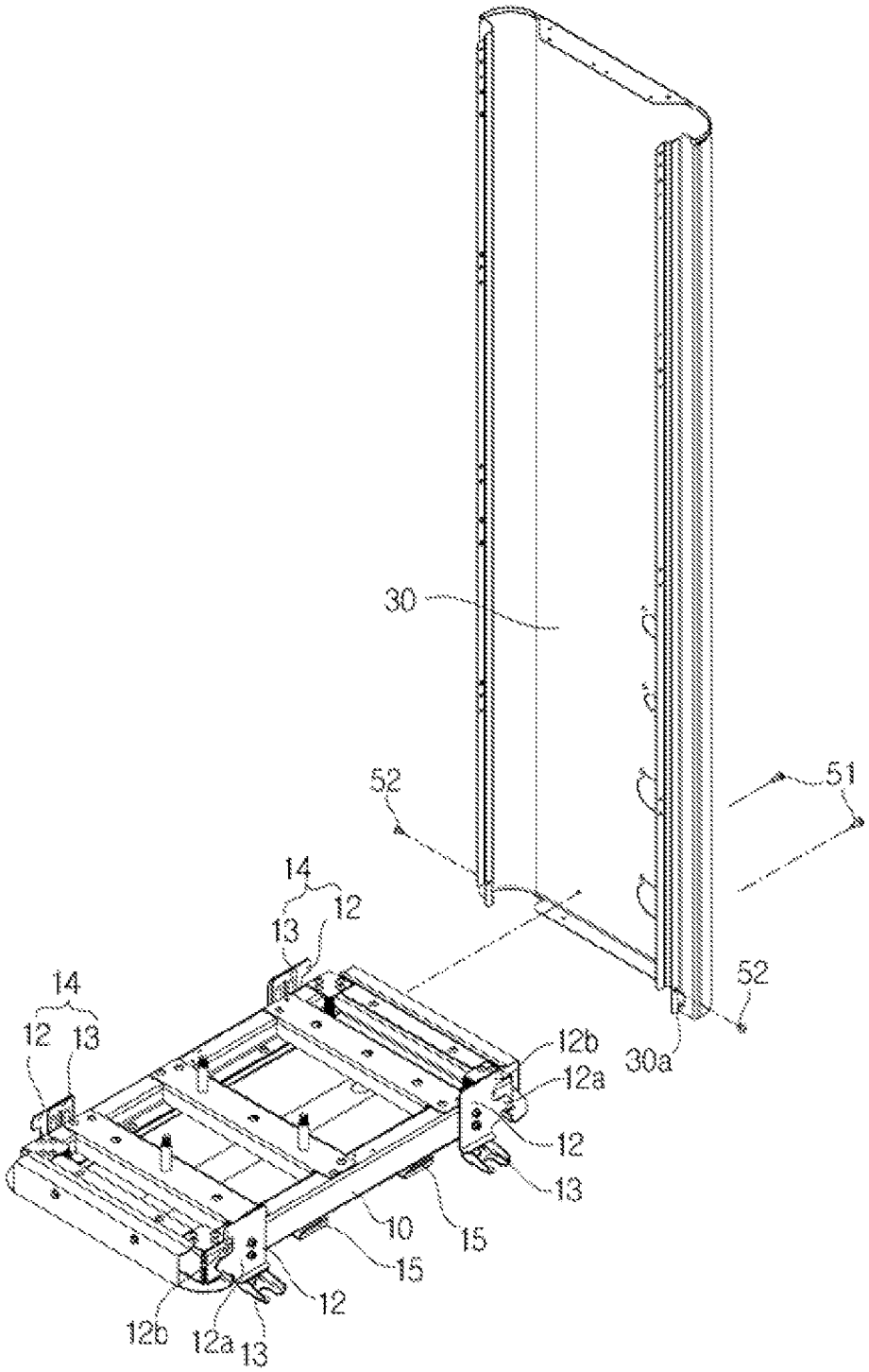
FIG. 3 is an exploded view illustrating a lower panel and a side panel of the air conditioner according to an embodiment of the disclosure.
Figure 4:
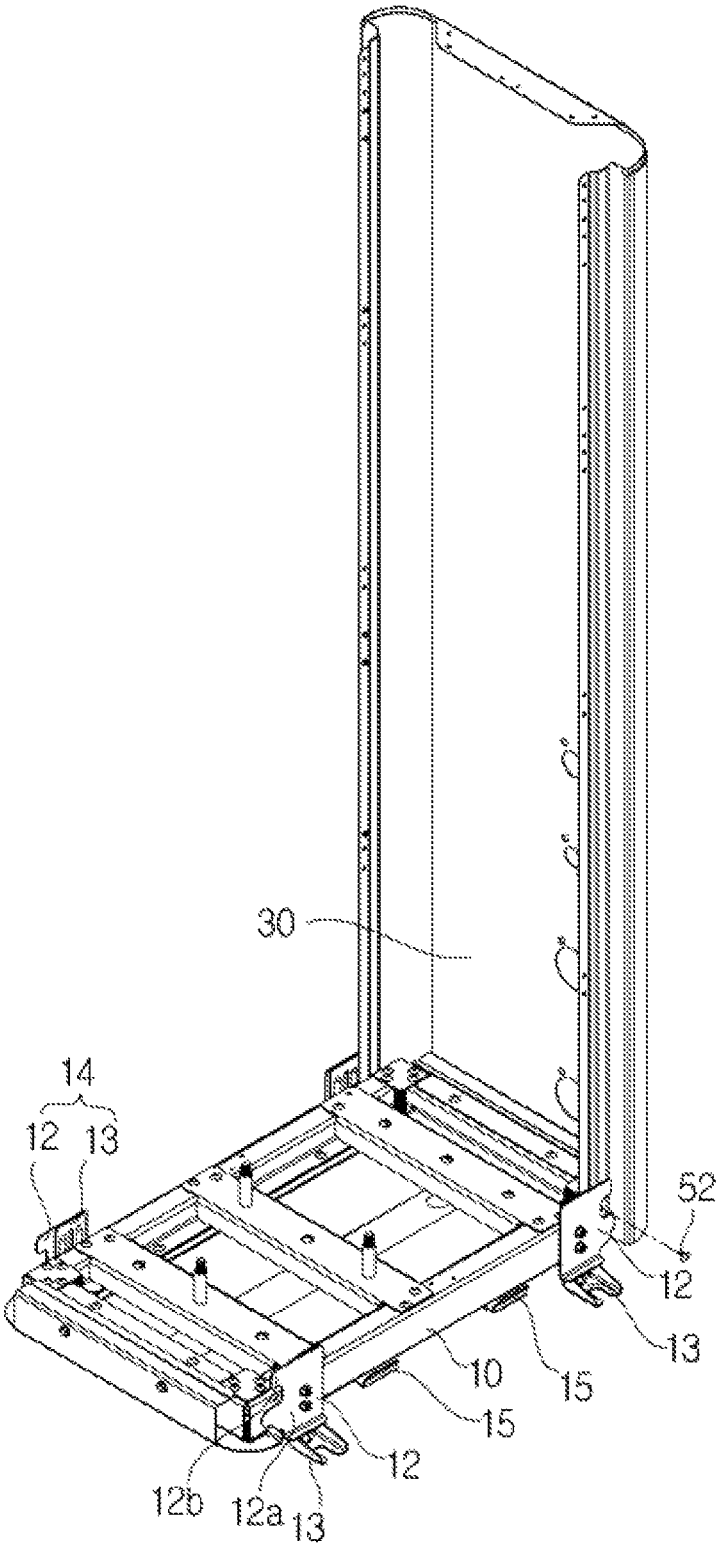
FIG. 4 is a view illustrating a coupled state between the lower panel and the side panel of the air conditioner according to an embodiment of the disclosure.

FIG. 3 is an exploded view illustrating the lower panel and the side panel of the electronic device according to an embodiment of the disclosure. FIG. 4 is a view illustrating a coupled state between the lower panel and the side panel of the electronic device according to an embodiment of the disclosure.

As shown in FIGS. 3 and 4, the lower panel 10 may be coupled to the side panels 30 by fitting a first protrusion 12*a* protruding from each coupling mediation member 14 into a first coupling groove 30*a* of each side panel 30. The first protrusion 12*a* may be provided at the first coupling mediation member 12. The first protrusion 12*a* may protrude in a direction of the adjacent side panel 30 and the first coupling groove 30*a* may be provided on an inner surface of the side panel 30. Accordingly, since the coupling of the first protrusion 12*a* and the first coupling groove 30*a* is not exposed to the outside, the coupling of the lower panel 10 and the side panel 30 are less likely to be deformable due to exposure to the outside. After the first protrusion 12*a* is coupled to the first coupling groove 30*a*, separate fastening members 51 and 52 may be additionally coupled thereto. For example, as shown in FIG. 3, one or more fastening members 51 (e.g., a screw), may be inserted at the exterior or outside surface of the side panel 30 through a hole or passage disposed in the side panel 30, to couple the side panel 30 to the lower panel 10. For example, as shown in FIG. 3, one or more fastening members 52 (e.g., a screw), may be inserted at the exterior or outside surface of the side panel 30 through a hole or passage disposed in the side panel 30, to couple the side panel 30 to the lower panel 10.

The first coupling mediation member 12 may include a fixed portion 12*b* which prevents the first protrusion 12*a* from swinging. The fixed portion 12*b* may be located at an upper end of the first protrusion 12*a* and protrude from the first coupling mediation member 12 in the direction of the adjacent side panel 30. The fixed portion 12*b* may have a protrusion length shorter than that of the first protrusion 12*a*. That is, the first protrusion 12 may extend further toward the adjacent side panel 30 than the fixed portion 12*b*. Accordingly, since the first protrusion 12*a* is inserted into the first coupling groove 30*a* and the fixed portion 12*b* comes into contact with the side panel 30, the first protrusion 12*a* may be prevented from swinging even though a separate fastening member is not fastened thereto. That is, when the first protrusion 12*a* is inserted into the first coupling groove 30*a*, the side panel 30 may be prevented from being decoupled outward the lower panel 10. In addition, since the fixed portion 12*b* serves to fix the side panel 30 at the upper side of the first protrusion 12*a*, the side panel 30 may be prevented from being decoupled inward of the panel assembly 100.

Figure 5A:
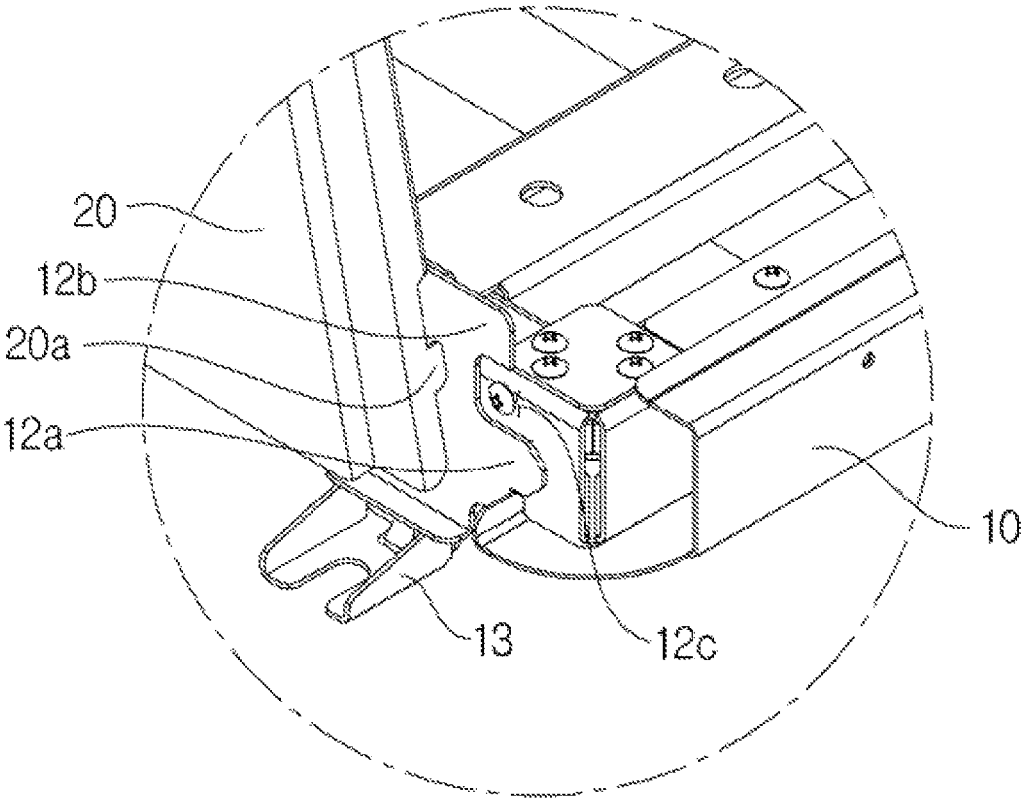
FIGS. 5A through 5C are enlarged views illustrating a coupling process between the lower panel and front and rear panels of the air conditioner according to an embodiment of the disclosure.
Figure 6A:
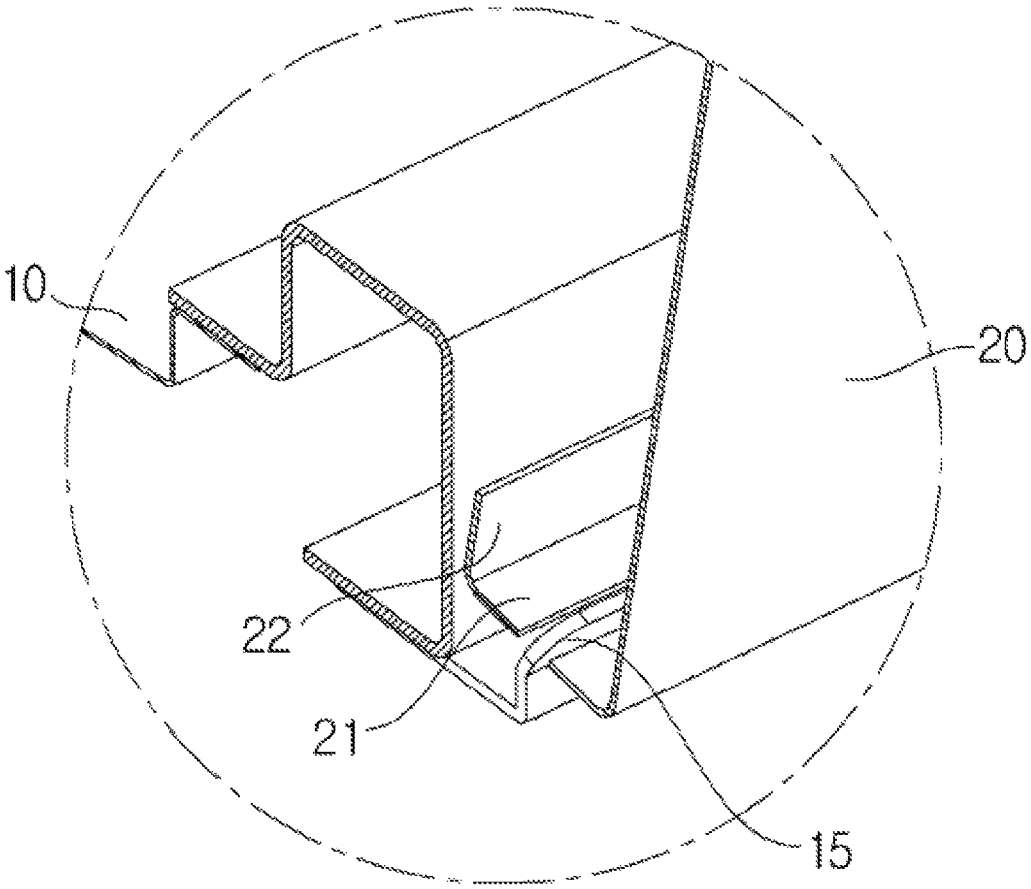
FIG. 6A through 6C are cross-sectional views illustrating the coupling process between the lower panel and the front and rear panels in FIGS. 5A through 5C.
Figure 7A:
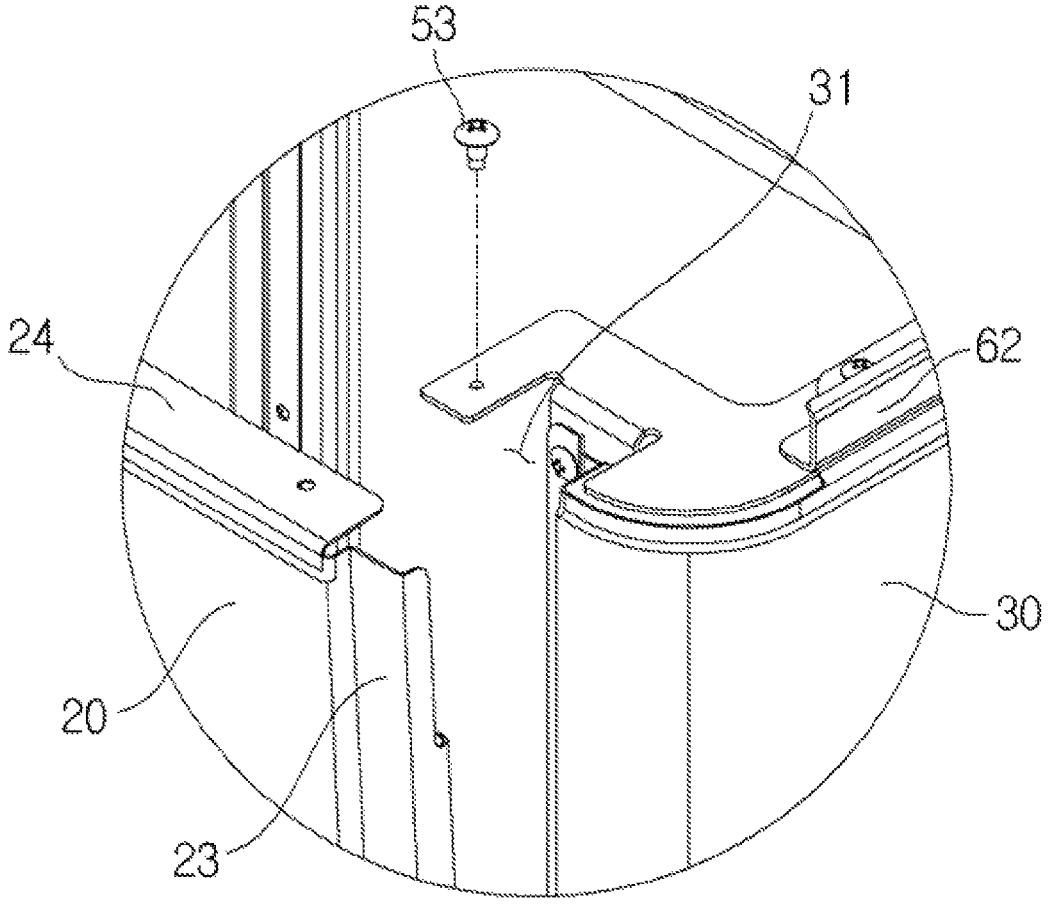
FIGS. 7A through 7C are enlarged views illustrating a coupling process between the front and rear panels and an upper panel of the air conditioner according to an embodiment of the disclosure.
Figure 7B:
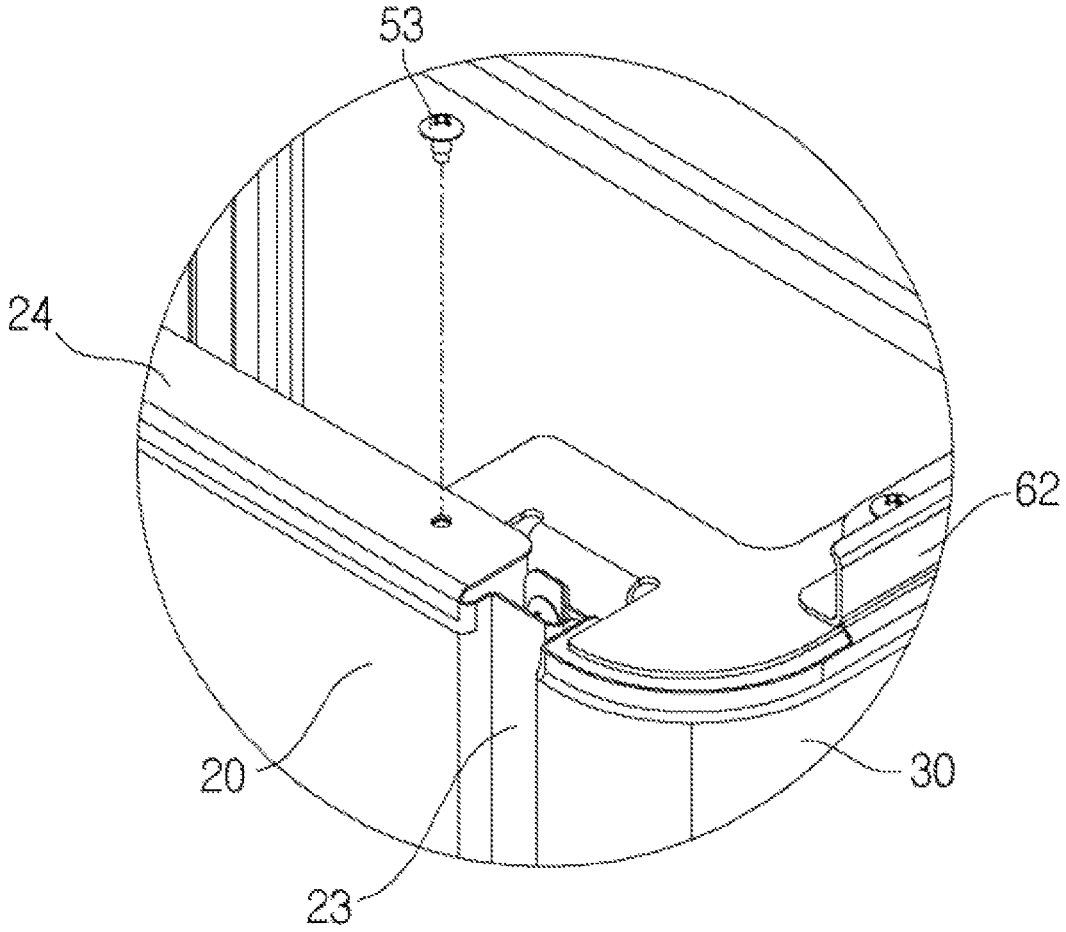
Figure 7C:
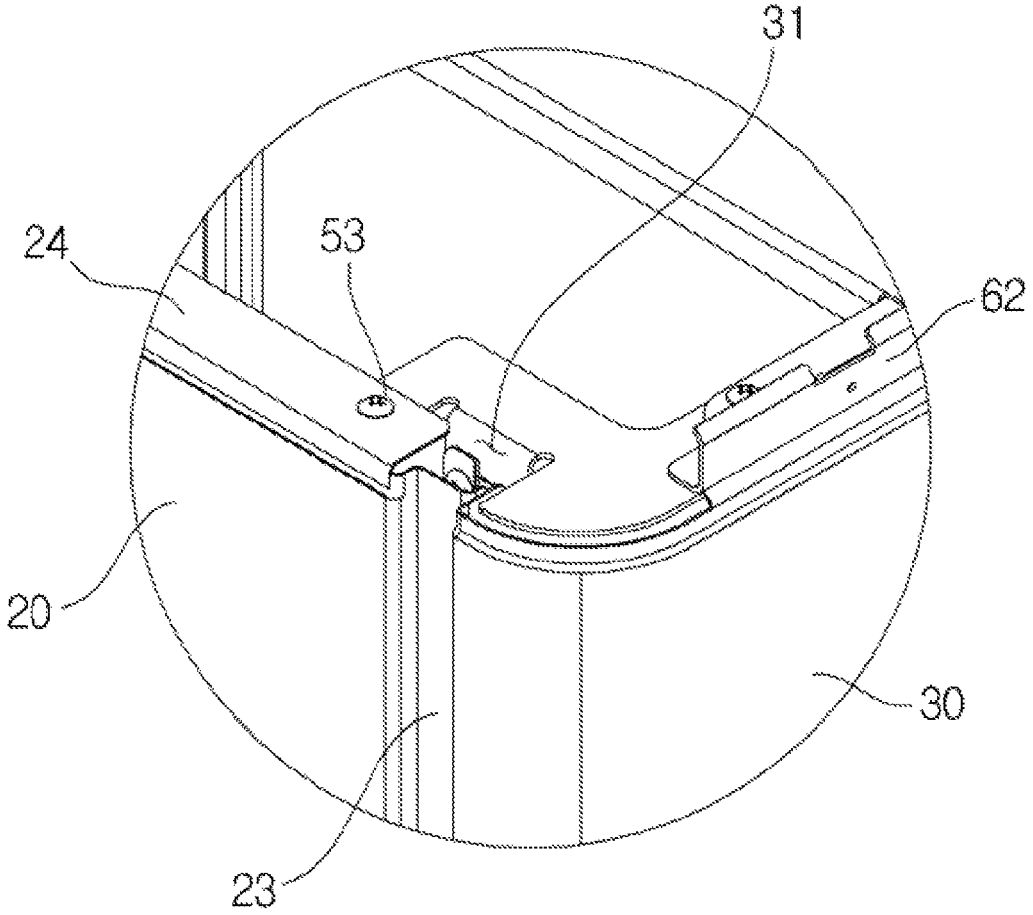
Figure 8A:
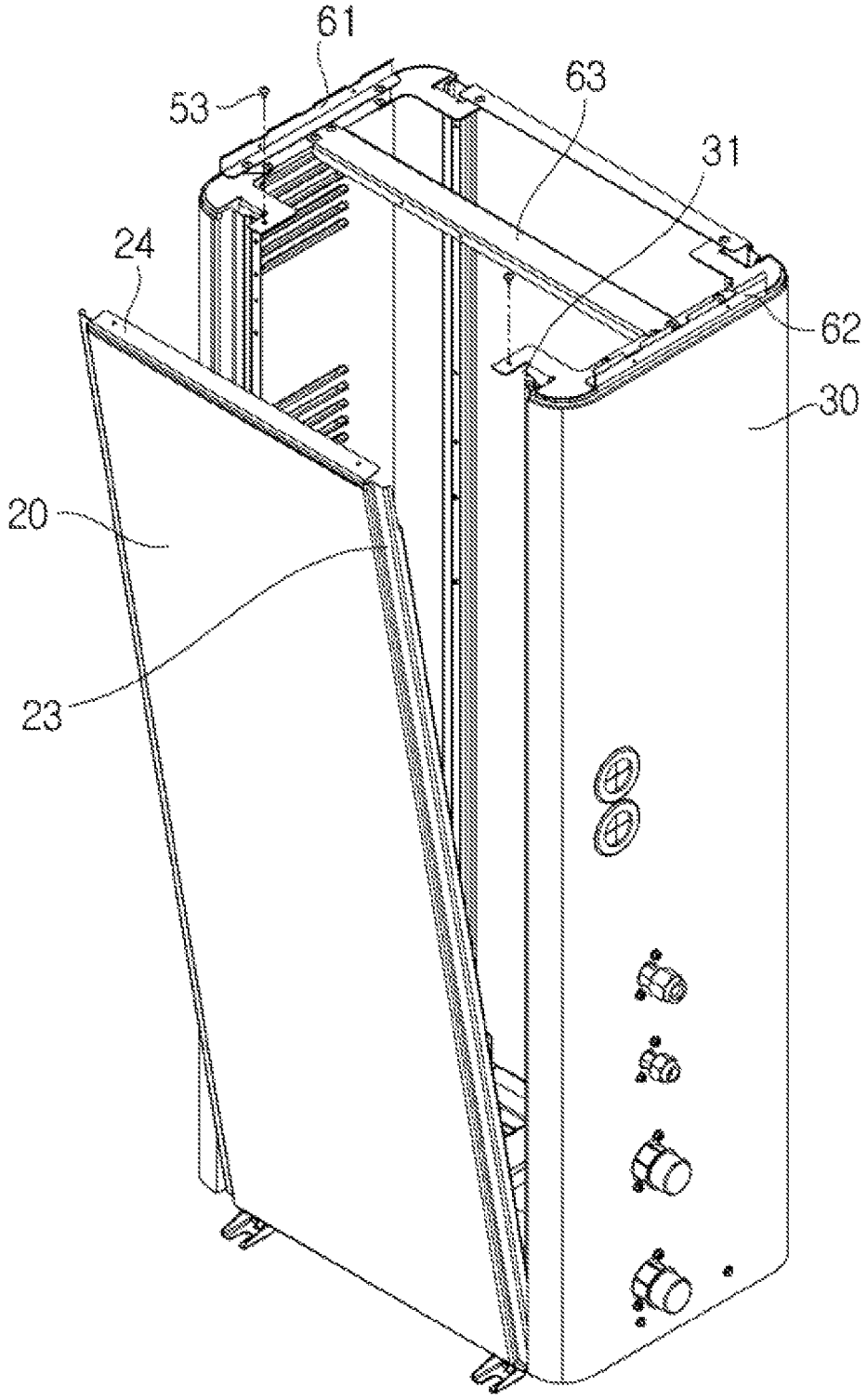
FIGS. 8A to 8B are views illustrating a coupling process between the front and rear panels and the upper and lower panels of the air conditioner according to an embodiment of the disclosure.
Figure 8B:
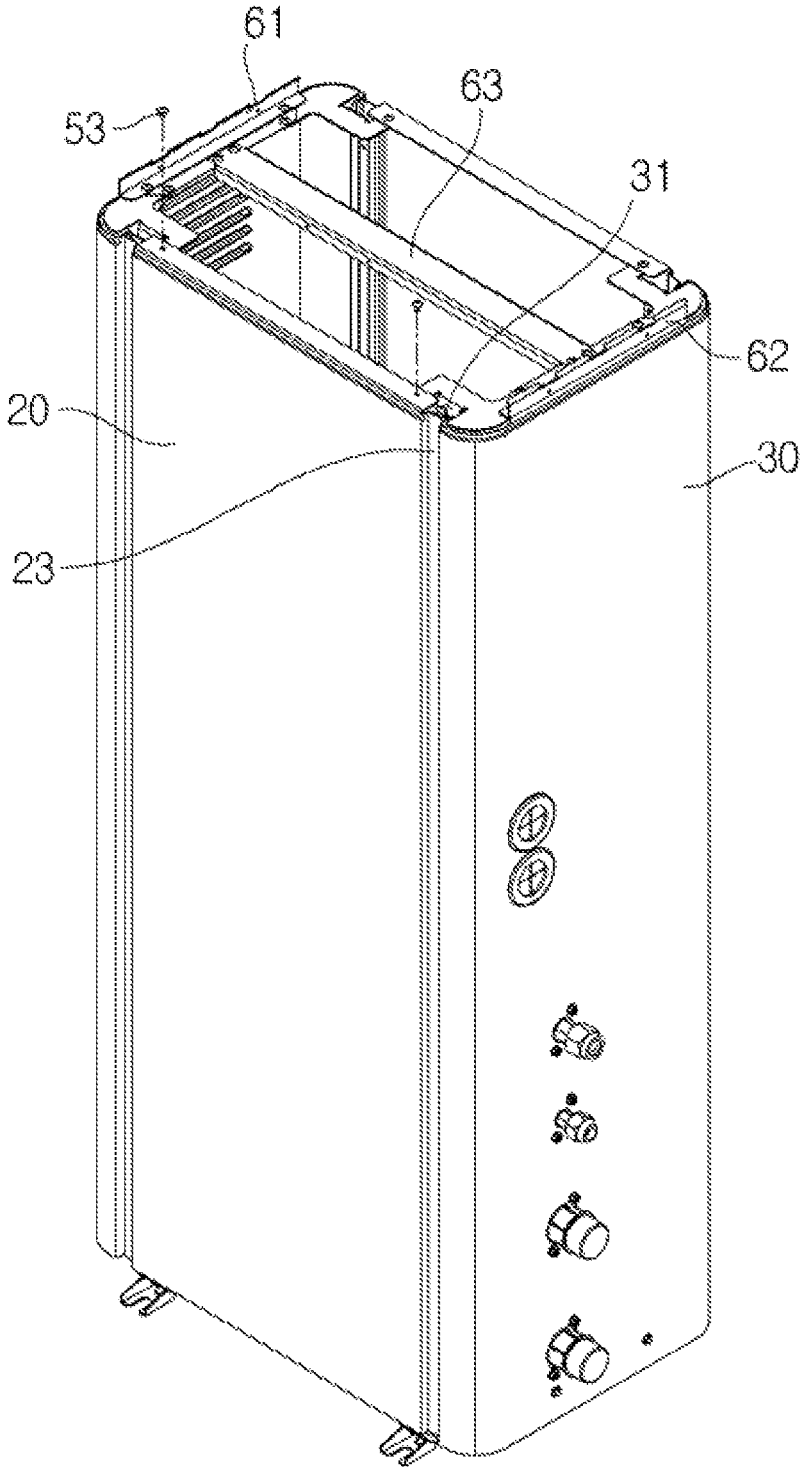

FIGS. 5A through 5A are enlarged views illustrating a coupling process between the lower panel and the front and rear panels of the electronic device according to an embodiment of the disclosure. FIGS. 6A through 6AC are cross-sectional views illustrating the coupling process between the lower panel and the front and rear panels in FIGS. 5A to 5C. FIGS. 7A to 7C are enlarged views illustrating a coupling process between the front and rear panels and the side panels of the electronic device according to an embodiment of the disclosure. FIGS. 8A to 8B are views illustrating a coupling process between the front and rear panels and the side and lower panels of the electronic device according to an embodiment of the disclosure.

Figure 5B:
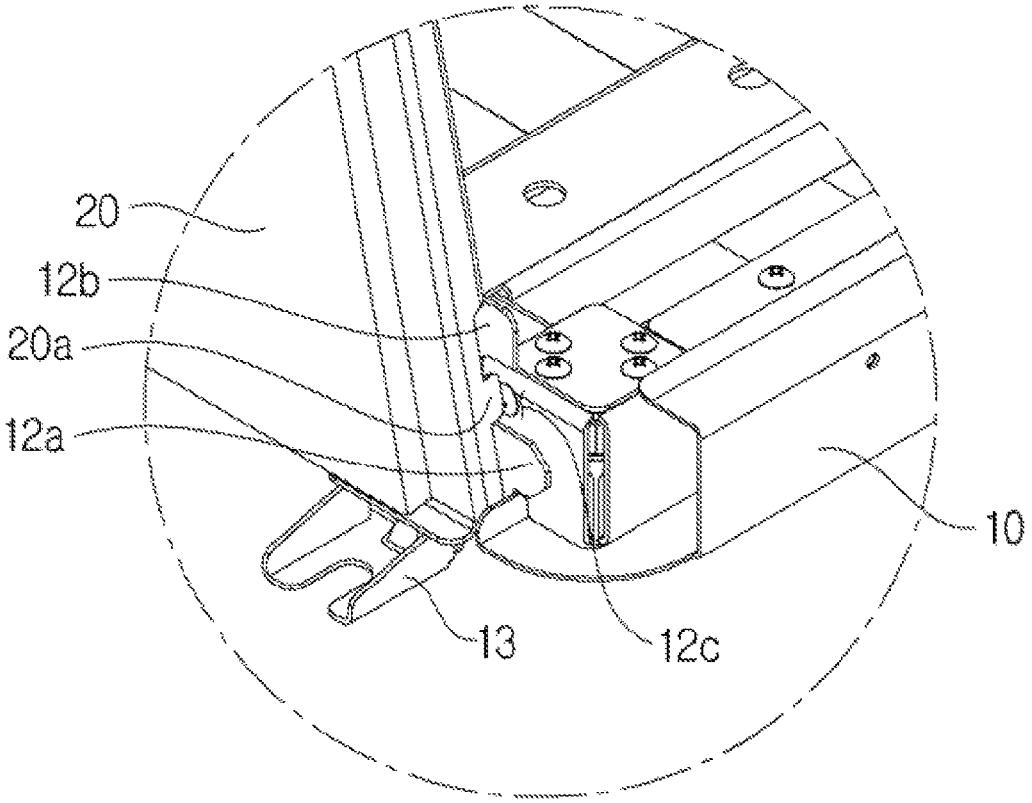
Figure 5C:
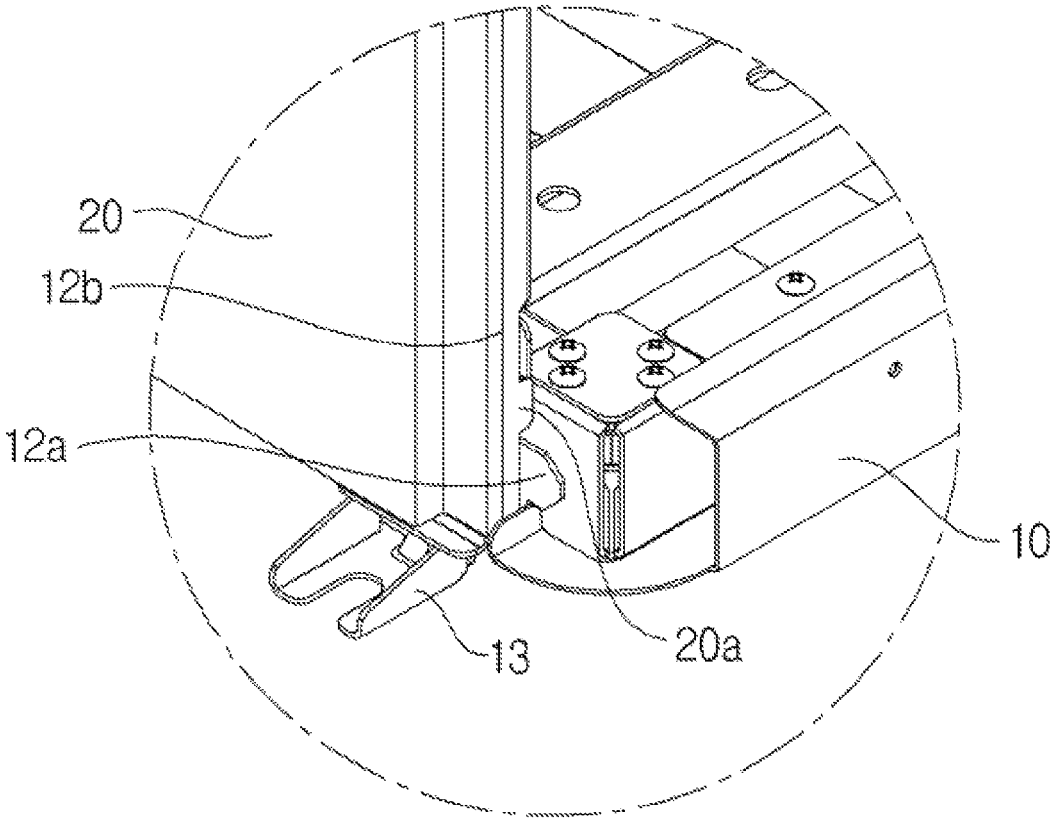

As shown in FIGS. 5A to 5C, a second protrusion 20*a*, which protrudes from a surface of each of the front and rear panels 20, may be inserted into a second coupling groove 12*c* provided between the first protrusion 12*a* and the fixed portion 12*b* of the first coupling mediation member 12, so that the front and rear panels 20 may be coupled to the lower panel 10.

Figure 6B:
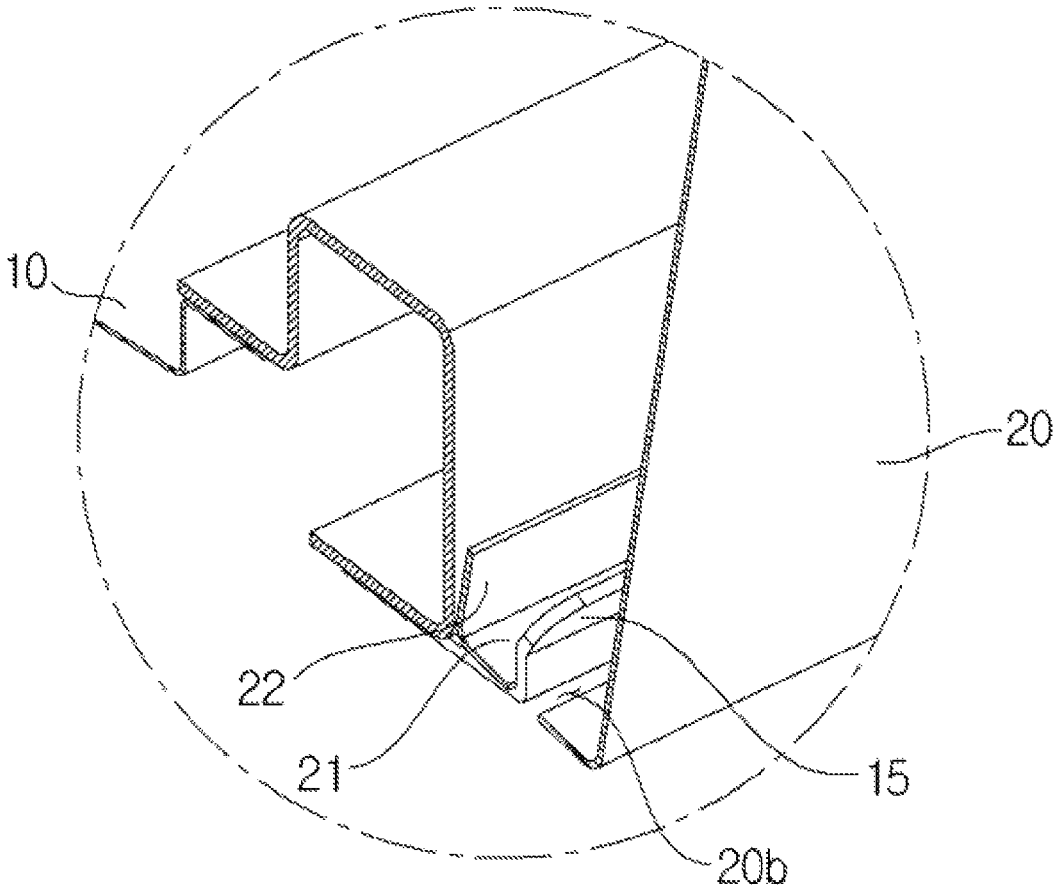
Figure 6C:
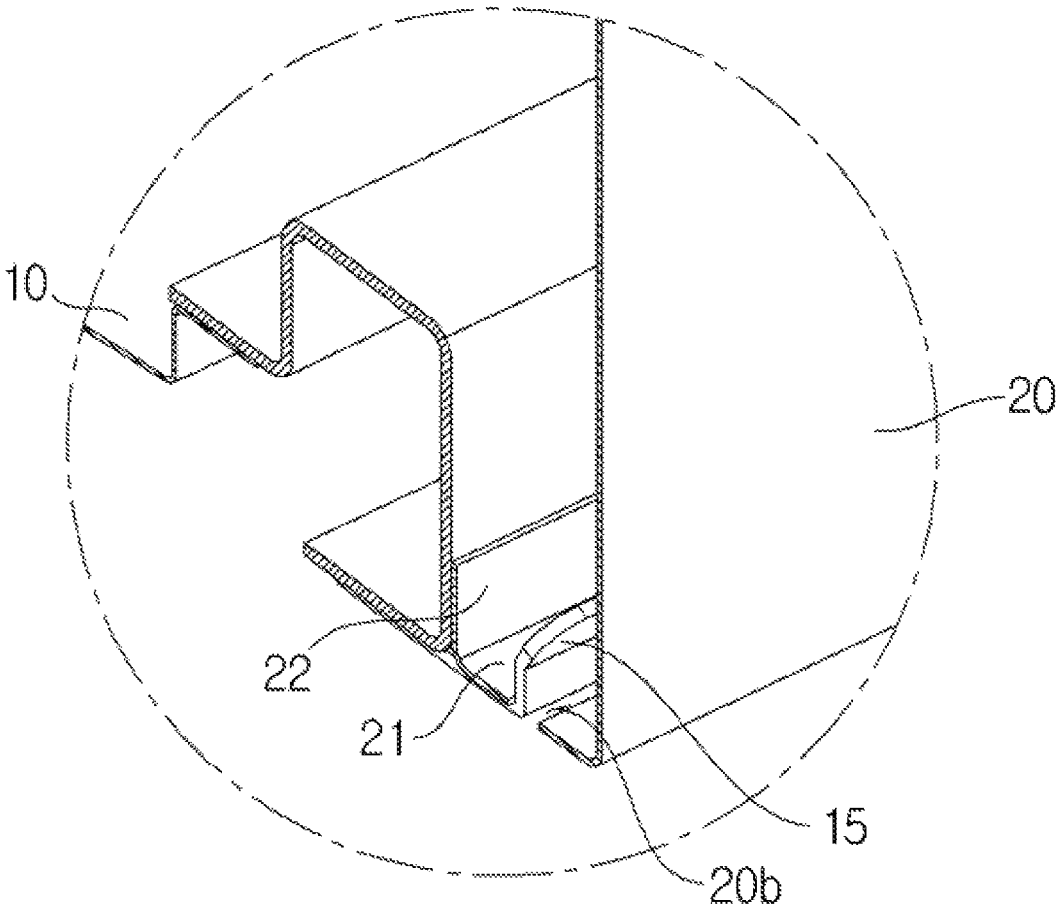

In addition, as shown in FIGS. 6A to 6C, the lower panel 10 may further include a guide portion 15 extending upward from one side of the lower panel 10. The guide portion 15 serves to guide a coupling position between the lower panel 10 and each of the front and rear panels 20 during coupling therebetween. The guide portion 15 may be coupled to a guide groove 21 formed on each of the front and rear panels 20 and the coupling position between the lower panel 10 and each of the front and rear panels 20 may be identified by the coupling of the guide portion 15 to the guide groove 21. The guide portion 15 may be coupled to the guide groove 21 and then the second protrusion 20*a* may be coupled to the second coupling groove 12*c*, so that the front and rear panels 20 may be coupled to the lower panel 10.

As shown in FIGS. 7A to 7C, each of the front and rear panels 20 may include a first extension portion 23 extending from a side surface thereof and a second extension portion 24 which extends from an upper surface thereof. The first extension portion 23 and second extension portion 24 may be bent inward of the panel assembly 100. The first extension portion 23 may be inserted into an insertion groove 31 provided on the associated side panel. The second extension portion 24 may enclose at least a portion of the upper surface of the side panel and a separate fastening member 53 may be coupled thereto. For example, as shown in FIGS. 7A to 7C, a fastening member 53 (e.g., a screw), may be inserted through a hole or passage disposed in an upper surface of the side panel 30 and a hole or passage disposed in the second extension portion 24, to secure or couple each of the side panel 30 and front and rear panels 20, together.

As shown in FIGS. 8A to 8B, the lower portions of the front and rear panels 20 may be coupled to the lower panel 10 and the front and rear panels 20 may rotate to be vertically coupled to the lower panel 10, thereby allowing the second extension portion 24 of each of the front and rear panels 20 to be inserted to the insertion groove 31. For example, as shown in FIGS. 8A to 8B, the fastening member 53 (e.g., a screw), may be inserted through a hole or passage which is formed on a substantially L-shaped protrusion which extends from an upper surface of the side panel 30.

Hereinafter, an assembly process of the front and rear panels 20 will be described with reference to FIGS. 5A to 8B.

As shown in FIG. 6A, the guide portion 15 may be located to be inserted into the guide groove 21. As shown in FIG. 5A, the front and rear panels 20 may be located at the lower panel 10 such that the second protrusion 20*a* of each of the front and rear panels 20 may be inserted into the associated second coupling groove 12*c* of the lower panel 10. In this case, the front and rear panels 20 are tilted outward with respect to the lower panel 10, as shown in FIG. 8A.

When the guide portion 15 is inserted into the guide groove 21 as shown in FIG. 6B and the front and rear panels 20 rotate in the direction perpendicular to the lower panel 10 as shown in FIG. 8B, the second protrusion 20*a* is inserted into the second coupling groove 12*c* formed on the front surface of the lower panel 10 as shown in FIG. 5B. In addition, during rotation of the front and rear panels 20, the first extension portion 23 is inserted into the associated insertion groove 31 of each of the side panels 30. As shown in FIGS. 6A through 6C, the coupling position where the guide portion 15 may be coupled to the guide groove 21 is formed at a lower portion of the front and rear panels 20, which may be substantially L-shaped. The lower portion of the L-shaped front and rear panels 20 may include the guide groove 21. The upper portion of the L-shaped front and rear panels 20 may extend vertically upward from an end of the lower portion of the L-shaped front and rear panels 20, and at the other end of the lower portion of the L-shaped front and rear panels 20, a bent portion 22 may extend vertically upward.

When the second protrusion 20*a* is fully inserted into the second coupling groove 12*c* as shown in FIG. 5C, the front and rear panels 20 are coupled to the lower panel 10 so as to be vertically located or oriented with respect to the lower panel 10.

In addition, as shown in FIG. 7C, the fastening member 53 may be coupled so as to pass through the second extension portion 24 of each of the front and rear panels 20 and the upper portion of each of the side panels 30. Since the upper panel 40 is coupled above the coupled fastening member 53, the fastening member 53 is not exposed to the outside, thereby preventing damage of the fastening member 53. As shown in FIGS. 7A to 7C, bracket 62 may be substantially L-shaped. The lower portion of the substantially L-shaped bracket 62 may be mounted, coupled to or installed on an upper surface of the side panel 30. The upper portion of the substantially L-shaped bracket 62 may extend vertically upward from the upper surface of the side panel 30, and a plurality of bent portions may extend inward from the upper portion of the substantially L-shaped bracket 62. A plurality of grooves may be formed between the plurality of bent portions. As shown in FIGS. 8A to 8*b*, bracket 61 may also be substantially L-shaped. The lower portion of the substantially L-shaped bracket 61 may be mounted, coupled to or installed on an upper surface of the other (opposite) side panel 30. The upper portion of the substantially L-shaped bracket 61 may extend vertically upward from the upper surface of the other (opposite) side panel 30, and a plurality of bent portions may extend inward from the upper portion of the substantially L-shaped bracket 61. A plurality of grooves may be formed between the plurality of bent portions. As discussed further, bracket 61 may be decoupled from side panel 30 and coupled to upper panel 40.

Since each lower portion of the front and rear panels 20 is coupled to the lower panel 10 by fitting of the second protrusion 20*a* into the second coupling groove 12*c* and each upper portion of the front and rear panels 20 is inserted into and coupled to the associated side panel 30 using the additional fastening member 53, the front and rear panels 20 may be fixed to the side panels 30 without movement thereof.

Figure 9:
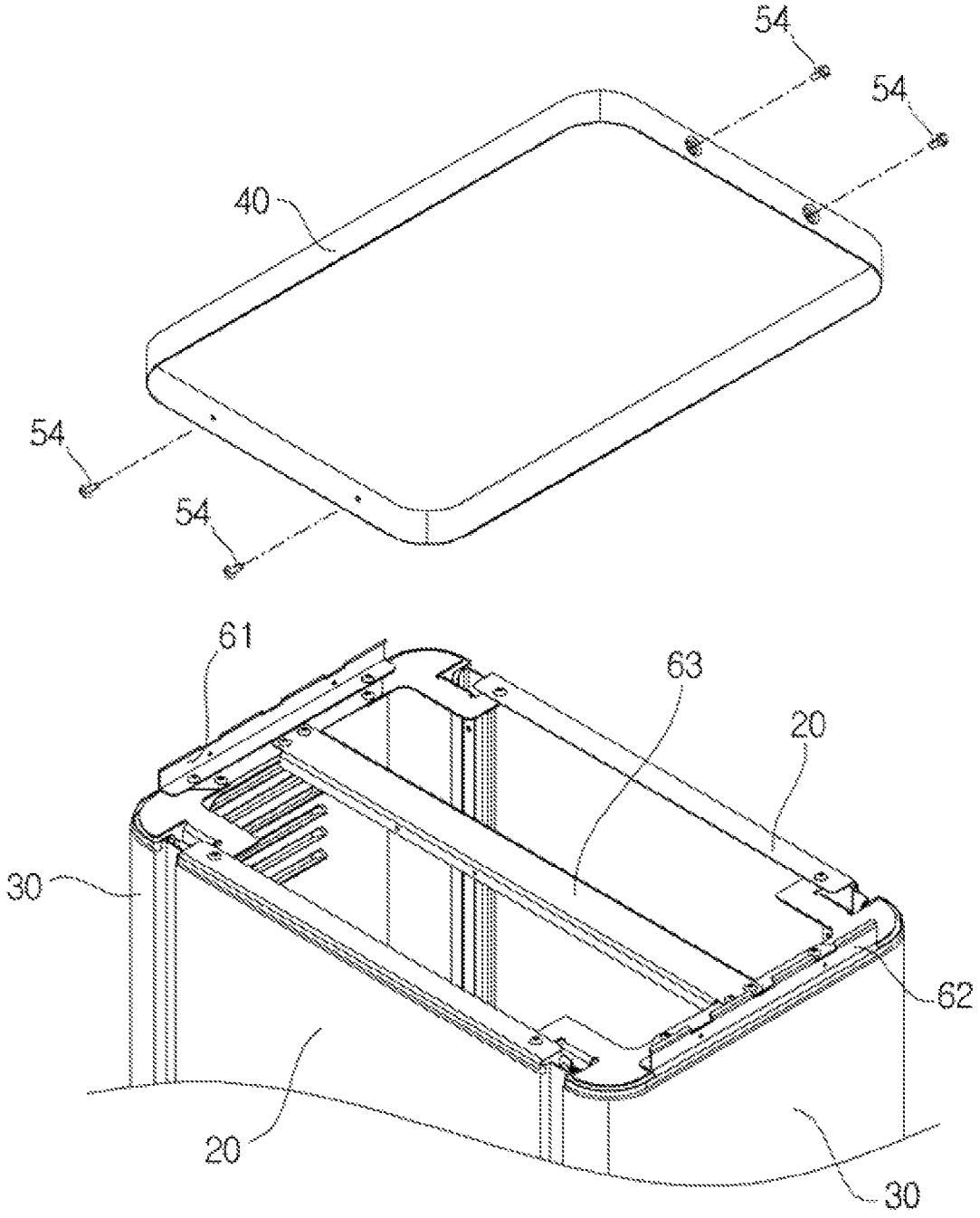
FIG. 9 is a view illustrating a disassembled state of the upper panel of the air conditioner according to an embodiment of the disclosure.

FIG. 9 is a view illustrating a disassembled state of the upper panel of the electronic device according to an embodiment of the disclosure.

As shown in FIG. 9, the upper panel 40 may be coupled to upper sides of the side panels 30 and the front and rear panels 20 by one or more fastening members 54. The upper sides of the side panels 30 may be coupled with brackets 61 and 62 through which the side panels 30 are coupled to the upper panel 40. At least a portion of each of the brackets 61 and 62 may protrude upward and the fastening members 54 may be coupled to the brackets 61 and 62. The fastening members 54 pass through the upper panel 40 and the brackets 61 and 62 so that the upper panel 40 may be coupled to the side panels 30.

A support member 63 may be coupled to both side panels 30 in order to prevent both side panels 30 from swinging inward of the panel assembly 100. Both side panels 40 may be maintained at regular distance by the support member 63. For example, the support member 63 may be disposed at a substantially central position of the side panels 30. The electronic device may utilize more than one support member coupled to both side panels 30.

Figure 10:
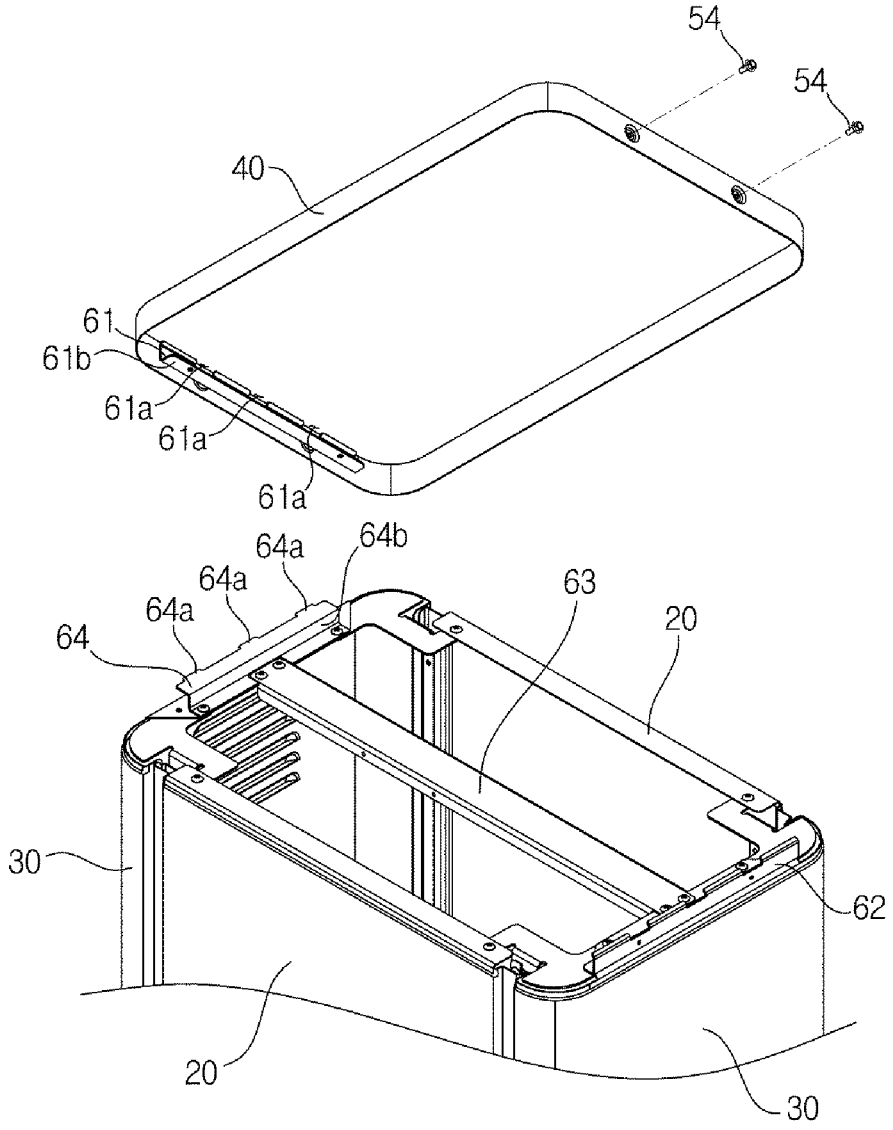
FIG. 10 is a view illustrating a disassembled state of an upper panel of an air conditioner according to an embodiment of the disclosure.

FIG. 10 is a view illustrating a disassembled state of an upper panel of an electronic device according to an embodiment of the disclosure.

As shown in FIG. 10, in accordance with an embodiment of the disclosure, an upper panel 40 may be coupled to the upper portion of any one of the side panels 30 by third protrusions 64*a* and third coupling grooves 61*a*. Although the third protrusions 64*a* may be provided on the upper portion of the side panel 30 and the third coupling grooves 61*a* may be provided on the lower portion of the upper panel 40 in accordance with an embodiment of the disclosure, the disclosure is not limited thereto. Further, there may be more than three or less than three third coupling grooves 61*a* and there may be more than three or less than three third protrusions 64*a*.

In accordance with an embodiment of the disclosure, the third protrusions 64*a* may be provided at a first bracket 64 coupled to the side panel 30 and the third coupling grooves 61*a* may be provided at a second bracket 61 coupled to the upper panel 40. Each of the third protrusions 64*a* may protrude outward of the side panel 30 and each of the third coupling grooves 61*a* may be provided in a shape corresponding to the associated third protrusion 64*a*. The upper panel 40 may be coupled to the upper portions of the side panels 30 by coupling of the third protrusions 64*a* and the third coupling grooves 61*a*.

The first bracket 64 may further include a first bracket bent portion 64*b* which is bent outward of the panel assembly 100 from the upper side of the side panel 30. The second bracket 61 may further include a second bracket bent portion 61*b* which is bent inward of the upper panel 40 to come into contact with the upper surface of the side panel 30 during coupling with the side panel 30. Accordingly, since a space is provided between the first and second brackets 64 and 61, the second bracket 61 rotates from the outer side of the panel assembly 100 to the inner side thereof during coupling of the side panel 30 and the upper panel 40, so that the third protrusions 64*a* may be coupled to the third coupling grooves 61*a*.

In accordance with an embodiment of the disclosure, the third protrusions 64*a* may be fitted into the third coupling grooves 61*a* at one side of the upper panel 40. The upper panel 40 may be coupled to the other side panel 30 using separate fastening members 54 at the other side of the upper panel 40. That is, a third bracket 62 to which the separate fastening members 54 are coupled may be located at the other side panel 30 so that the upper panel 40 is coupled to the side panel 30.

In accordance with an embodiment of the disclosure, the fastening members 54 may be used at only one surface of the panel. Therefore, even when the air conditioner is installed on a wall surface, the fastening members 54 may be used at the other surface of the panel which is not in contact with the wall surface, thereby enabling the upper panel 40 to be easily disassembled for repair and reinspection of an electronic device (e.g., the air conditioner 1). In addition, fitting coupling of the panels may be performed by the third protrusions 64*a* and the third coupling grooves 61*a* which are respectively formed at the first and second brackets 64 and 61. Therefore, fastening positions of the fastening members 54 may be changed according to installation positions, namely, the left or the right of the first and second brackets 64 and 61. Thus, a user may change the fastening positions of the fastening members 54 according to an installation environment of the electronic device.

FIGS. 11A to 11E are views illustrating a process of changing a coupling method of the upper panel of the electronic device according to an embodiment of the disclosure.

As shown in FIGS. 11A to 11E, a coupling method between the upper panel 40 and the side panels 30 may be changed by converting the embodiment shown in FIG. 9 into the embodiment of the disclosure shown in FIG. 10.

Figure 11A:
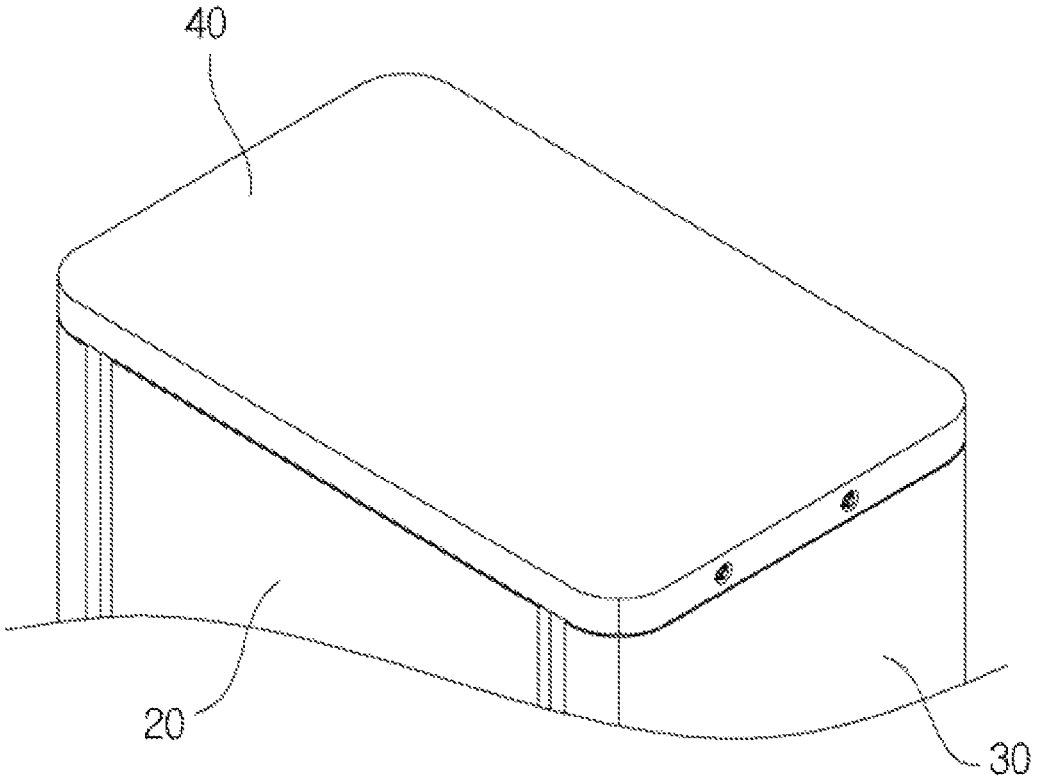
FIGS. 11A through 11E are views illustrating a process of changing a coupling method of the upper panel of the air conditioner according to an embodiment of the disclosure.
Figure 11B:
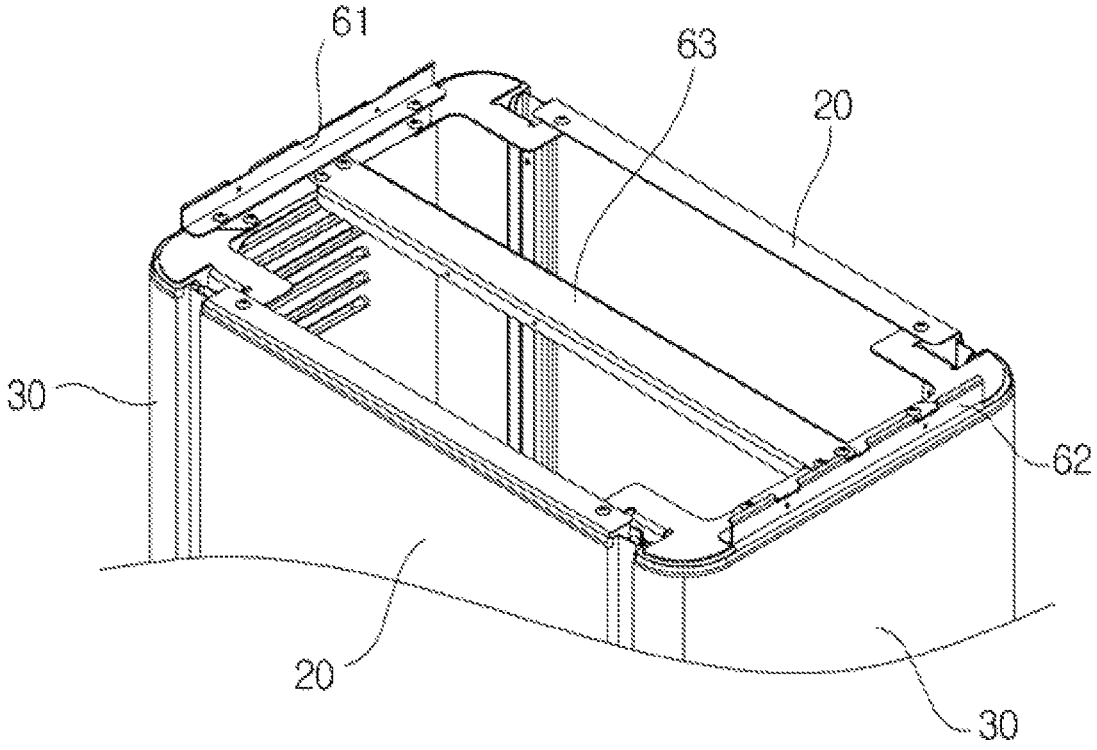
Figure 11C:
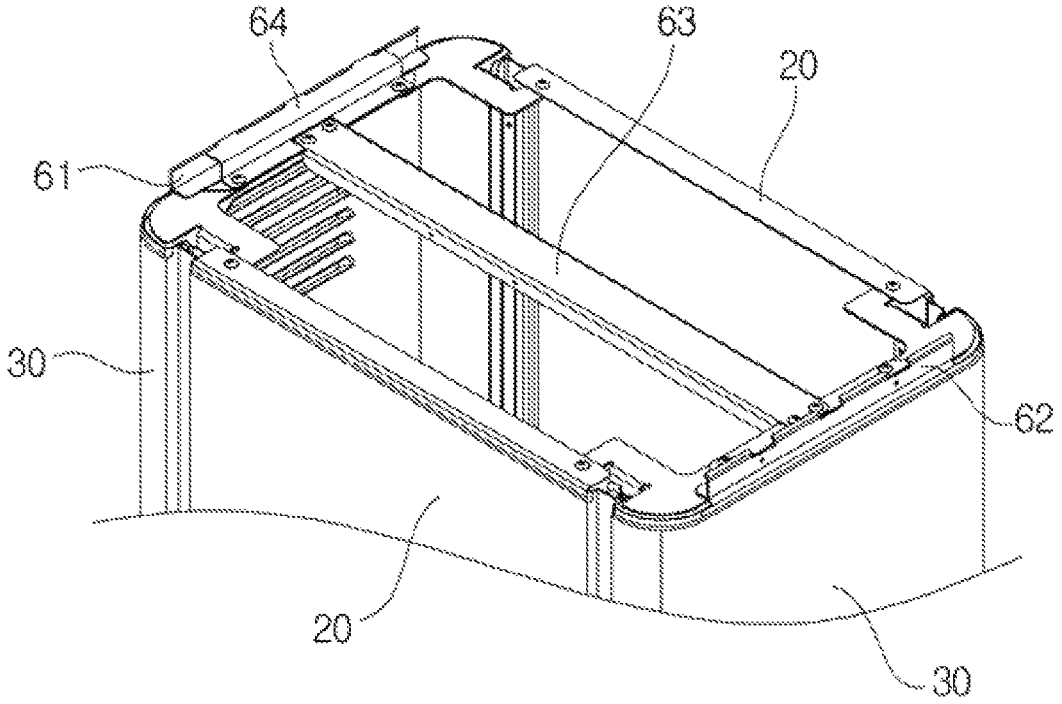
Figure 11D:
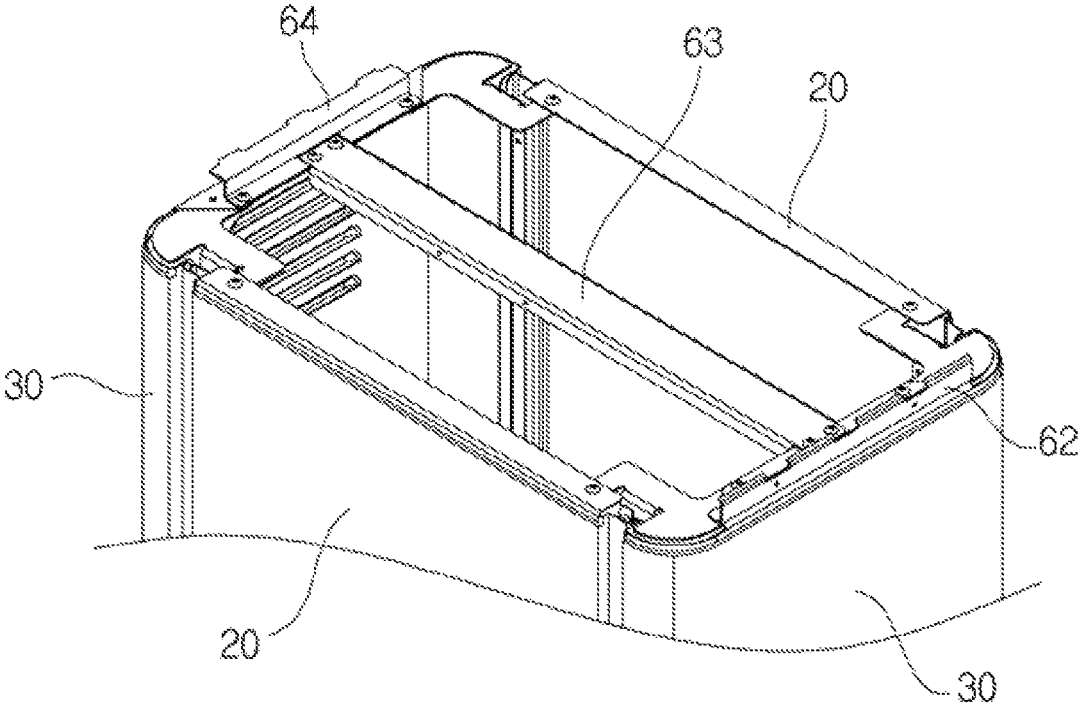
Figure 11E:
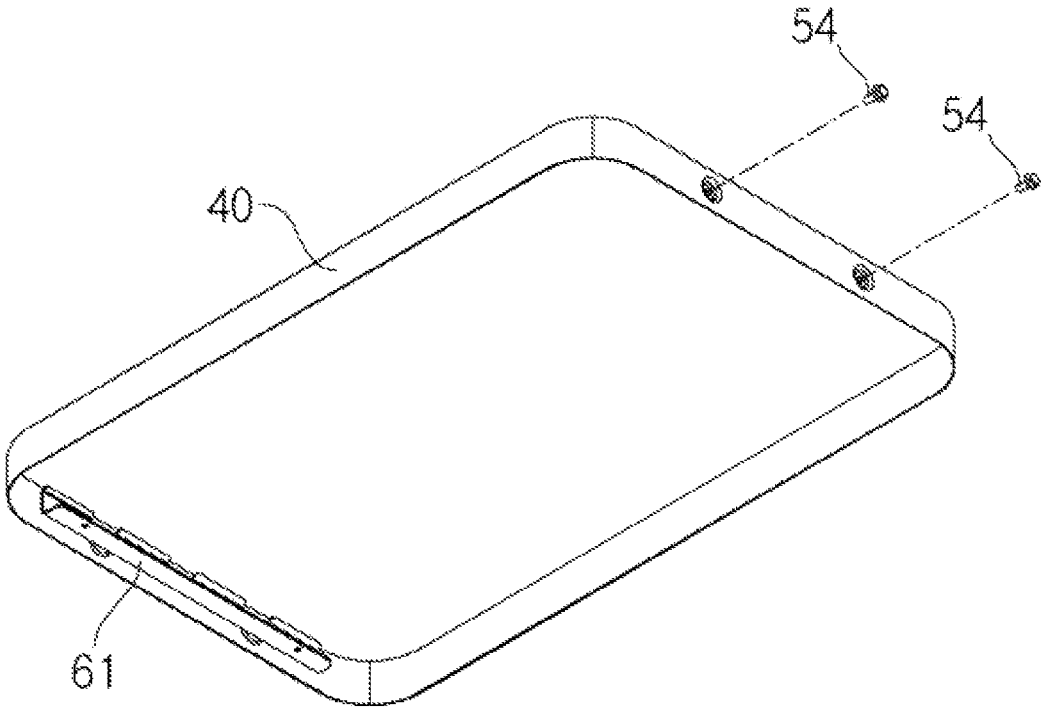

The upper panel 40 of FIG. 11A may be disassembled by decoupling the fastening members 54 (e.g. from one or more sides of the upper panel 40) and the first bracket 64 may be coupled to one side of side panel 30 as shown in FIG. 11C. In this case, a bracket located at a side to which the first bracket 64 is coupled is defined as the second bracket 61. Subsequently, the second bracket 61 located at the side to which the first bracket 64 is coupled is decoupled from the side panel 30, as shown in FIG. 11D. As shown in FIG. 11E, the decoupled second bracket 61 is coupled to the upper panel 40. Thus, the side panel 30 may be fitted to the upper panel 40 by the second bracket 61 of the upper panel 40 and the first bracket 64 of the side panel 30. In addition, the fastening members 54 may be fastened to the other side of the upper panel 40 so that the upper panel 40 is coupled to the third bracket 62 of the side panel 30.

As is apparent from the above description, it may be possible to provide an air conditioner capable of reducing the number of fastening members coupled to respective panels and being free from restraint of an installation space by minimizing fastening directions of the fastening members to reduce a space required during disassembly and reassembly of the panels. Further, deterioration of fastening members or other components and/or deformation of panels, may be avoided by positioning of the fastening members or other components (e.g., protrusions and grooves) according to the above described example embodiments.

In the example embodiments disclosed herein, reference has been made generally to one or more brackets which may be formed, located, positioned, disposed, mounted, installed, etc. on any one of the side panels 30, and which may be fastened or coupled to the upper panel, via fasteners, another bracket, etc. However, the disclosure is not so limited. For example, one or more brackets may formed, located, positioned, disposed, mounted, installed, etc. on one of or both of the front and rear panels 20, in addition to or alternatively, with respect to the one or more brackets which may be formed, located, positioned, disposed, mounted, installed, etc. any one of the side panels 30.

In the example embodiments disclosed herein, reference has been made generally to an electronic device such as an air conditioner. However, the disclosure is not so limited and may be applied to other electronic devices other than an air conditioner. Further, the disclosure is not limited to the example embodiment of a rectangular shaped panel assembly. For example, aspects of the example embodiments may be applied to a panel assembly having a different shape (e.g., a square shaped panel assembly, cylinder shaped panel assembly, spherical shaped panel assembly, or other geometric shapes, and the like).

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. An air conditioner comprising:

a lower panel located at a bottom surface of the air conditioner;

a front panel and a rear panel located at front and rear surfaces of the air conditioner, respectively; and side panels to couple the front and rear panels, wherein a side of the lower panel is provided with a protrusion and a side of at least one of the front panel, rear panel and side panels is provided with a coupling groove, to couple the lower panel to the at least one of the front panel, rear panel and the side panels by coupling of the protrusion and the coupling groove, wherein first protrusions provided on the lower panel protrude in a direction toward inner side surfaces of corresponding side panels, the first protrusions being fitted into first coupling grooves provided in the inner side surfaces of the corresponding side panels to couple the lower panel to the corresponding side panels, the inner side surface of each corresponding side panel facing one another, a fixed portion is formed on the lower panel above each first protrusion to prevent the first protrusion from swinging, each fixed portion protrudes in a same direction as a corresponding first protrusion therebelow, and has a shorter protrusion length than a protrusion length of the corresponding first protrusion, and a second protrusion protrudes from a side surface of each of the front and rear panels and is inserted into a corresponding second coupling groove disposed between each fixed portion and corresponding first protrusion in the lower panel to couple the front and rear panels to the lower panel.

2. The air conditioner according to claim 1, further comprising:

guide portions extending upward from the lower panel, wherein the guide portions are coupled to guide grooves formed in the front and rear panels to guide coupling positions between the front and rear panels and the lower panel.

3. The air conditioner according to claim 1, wherein the front and rear panels are fitted to the side panels.

4. The air conditioner according to claim 1, further comprising an upper panel located at an upper surface of the air conditioner, fastened to the front and rear panels and the side panels by separate fastening members.

5. The air conditioner according to claim 1, further comprising an upper panel located at an upper surface of the air conditioner, wherein the first one of the side panels is provided with a third protrusion portion which protrudes from at least a portion thereof and the third protrusion portion is coupled to a third coupling groove provided in the upper panel.

6. The air conditioner according to claim 5, wherein the third protrusion portion is provided in a first bracket coupled to the first one of the side panels and the third protrusion portion protrudes outward of the first one of the side panels.

7. The air conditioner according to claim 5, wherein the third coupling groove is provided in a second bracket coupled to the upper panel.

8. An air conditioner comprising:

a lower panel located at a bottom surface of the air conditioner;

a front panel and a rear panel located at front and rear surfaces of the air conditioner, respectively;

side panels to couple the front and rear panels; and coupling mediation members coupled to the lower panel to assist coupling between the front and rear panels and the lower panel and between the side panels and the lower panel, wherein one side of each coupling mediation member is provided with a first protrusion which protrudes in a direction toward an inner side surface of a first one of the side panels, the first protrusion being fitted into a first coupling groove provided in the inner side surface of the first one of the side panels to couple the lower panel to the first one of the side panels, the inner side surface of the first one of the side panels faces an inner side surface of a second one of the side panels provided opposite of the first one of the side panels, a fixed portion is formed on the lower panel above each first protrusion to prevent the first protrusion from swinging, each fixed portion protrudes in a same direction as a corresponding first protrusion therebelow, and has a shorter protrusion length than a protrusion length of the corresponding first protrusion, and a second protrusion protrudes from a side surface of each of the front and rear panels and is inserted into a corresponding second coupling groove disposed between one of the fixed portions and one of the first protrusions in the lower panel to couple the front and rear panels to the lower panel.

9. The air conditioner according to claim 8, wherein the lower panel further comprises guide portions extending upward from the lower panel to guide coupling between the front and rear panels and the lower panel, and the guide portions are coupled to guide grooves formed in the front and rear panels.

10. The air conditioner according to claim 8, further comprising an upper panel located at an upper surface of the air conditioner, wherein the upper panel is fastened to the front and rear panels and the side panels by separate fastening members.

11. The air conditioner according to claim 8, further comprising an upper panel located at an upper surface of the air conditioner, wherein a first bracket, which is coupled to one side of the first one of the side panels, is coupled to a second bracket coupled to one side of the upper panel, and the second one of the side panels is coupled to the other side of the upper panel by a separate fastening member.

12. The air conditioner according to claim 11, wherein the first bracket is provided with a third protrusion portion protruding outward of the first one of the side panels and the second bracket is provided with a third coupling groove having a shape corresponding to the third protrusion portion such that the third protrusion portion is coupled to the third coupling groove.

13. An air conditioner comprising:

an upper panel located at an upper surface of the air conditioner;

front and rear panels located at front and rear surfaces of the air conditioner;

a first side panel and a second side panel to couple the front and rear panels;

a first bracket which is coupled to an upper surface of the first side panel facing the upper panel, the first bracket being formed with a first portion which protrudes upward toward the upper panel, a second portion which protrudes in an outward lateral direction from an upper portion of the first portion, and a protrusion extending from the second portion in the outward lateral direction; and a second bracket which is coupled to a side surface of an inner wall of the upper panel, the second bracket comprising:

a third portion which extends inward of the side surface of the upper panel to come into contact with the upper surface of the first side panel during coupling with the first side panel, a fourth portion extending upward from the third portion and coupled to the side surface of the inner wall of the upper panel, and a bent portion extending inward from a top of the fourth portion, the bent portion being formed with a coupling groove coupled with the protrusion, wherein the first side panel is coupled to the upper panel by coupling of the first and second brackets.

14. The air conditioner according to claim 13, further comprising:

a third bracket coupled to one side of the second side panel, wherein the third bracket is coupled to the upper panel using a separate fastening member.

15. The air conditioner according to claim 13, further comprising a support member coupled at one end to the upper surface of first side panel and at another end to an upper surface of the second side panel, the support member being longitudinally disposed in a substantially central location between the front and rear panels.

16. The air conditioner according to claim 13, wherein the protrusion is wholly disposed on an inside of the air conditioner.

17. The air conditioner according to claim 13, wherein the upper panel comprises an upper side and a plurality of side walls which extend downward from outer edges of the upper side, the second bracket is coupled to a first side wall among the plurality of side walls, a second side wall opposite to the first side wall is formed with a hole through which a fastening member enters from the outside to couple the second side wall to the second side panel, and the second side wall is the only side wall among the plurality of side walls through which a fastening member enters from the outside.

18. An electronic device comprising:

a lower panel disposed at a bottom surface of the electronic device;

an upper panel disposed at an upper surface of the electronic device;

a front panel and a rear panel disposed at front and rear surfaces of the electronic device, respectively;

first and second side panels to couple the front and rear panels;

a first bracket configured to be selectively coupled to an upper surface of the first side panel or to an interior portion of a first side of the upper panel; and a second bracket coupled to an upper surface of the second side panel, wherein a first side of the lower panel is provided with a first protrusion and a side of at least one of the front panel, rear panel and side panels is provided with a first coupling groove, to couple the lower panel to at least one of the front panel, rear panel and the side panels by coupling of the first protrusion and the first coupling groove, and a second side of the lower panel, adjacent to the first side, is provided with a second groove and a side of at least one of the front panel, rear panel and side panels is provided with a second protrusion, to couple the lower panel to at least one of the front panel, rear panel and the side panels by coupling of the second protrusion and the second coupling groove, wherein when the first bracket is coupled to the upper surface of the first side panel, fastening members pass through first and second sides of the upper panel to the first and second side panels via the first bracket and the second bracket, respectively, and when the first bracket is coupled to the interior portion of the upper panel, fastening members pass through only the second side of the upper panel to the second side panel via the second bracket, to couple the second side of the upper panel to the second side panel.

19. The electronic device of claim 18, wherein the second side of the lower panel is provided with a plurality of guide portions which extend upward from the lower panel, and the plurality of guide portions are coupled together with guide grooves formed in the front and rear panels, such that the front and rear panels are rotatable about the lower panel.

20. The electronic device of claim 18, wherein at least one of the front and rear panels is provided with a third protrusion, and at least one of the side panels is provided with a third coupling groove, to couple one of the front and rear panels to at least one of the side panels.

21. The electronic device of claim 18, wherein when the first bracket is coupled the Interior portion of the upper panel, the first bracket is coupled to a third bracket disposed on the upper surface of the first side panel, such that the upper panel is rotatable about the first side panel.

* * * * *